US012092359B2

(12) United States Patent
Hayashi et al.

(10) Patent No.: US 12,092,359 B2
(45) Date of Patent: Sep. 17, 2024

(54) INDOOR UNIT FOR AIR-CONDITIONING APPARATUS AND AIR-CONDITIONING APPARATUS

(71) Applicant: Mitsubishi Electric Corporation, Tokyo (JP)

(72) Inventors: Kenta Hayashi, Tokyo (JP); Yusaku Seki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 237 days.

(21) Appl. No.: 17/780,723

(22) PCT Filed: Feb. 19, 2020

(86) PCT No.: PCT/JP2020/006518

§ 371 (c)(1),
(2) Date: May 27, 2022

(87) PCT Pub. No.: WO2021/166121

PCT Pub. Date: Aug. 26, 2021

(65) Prior Publication Data

US 2023/0010667 A1 Jan. 12, 2023

(51) Int. Cl.
*F24F 13/20* (2006.01)
*F24F 1/0059* (2019.01)

(52) U.S. Cl.
CPC ..... *F24F 13/20* (2013.01); *F24F 1/0059* (2013.01)

(58) Field of Classification Search
CPC ..... F24F 13/20; F24F 1/0059; F24F 1/0035; F24F 1/0047; F24F 13/0263; F24F 1/0038; F24F 1/005; F24F 1/0057; F24F 1/0063; F24F 1/0067
See application file for complete search history.

(56) References Cited

U.S. PATENT DOCUMENTS 4,951,737 A * 8/1990 Tenhundfeld ..... F24F 1/027 62/262
5,029,810 A * 7/1991 Finnerty ..... F24F 1/0035 454/259

FOREIGN PATENT DOCUMENTS

EP 1693626 A1 8/2006
JP H04-113827 U 10/1992
JP 2004198014 A * 7/2004
(Continued)

OTHER PUBLICATIONS

International Search Report of the International Searching Authority mailed Mar. 24, 2020 in corresponding application No. PCT/JP2020/006518 (and English translation).

*Primary Examiner* — Harry E Arant
(74) *Attorney, Agent, or Firm* — Posz Law Group, PLC

(57) ABSTRACT

An indoor unit for an air-conditioning apparatus includes an insulation box that has a space that receives a heat exchanger, an insulation panel that is disposed between the insulation box and an outer panel and that has an air inlet passage and an air outlet passage, and a casing to which the outer panel is attached. The casing contains the insulation box and the insulation panel. The insulation box has a first outside-air introduction passage that is located apart from the space and that is communicable with an outside of the casing. The insulation panel has a second outside-air introduction passage that is located apart from the air outlet passage and that is communicable between the first outside-air introduction passage and the air inlet passage.

15 Claims, 22 Drawing Sheets

(56) References Cited

FOREIGN PATENT DOCUMENTS

| | | | | | |
|---|---|---|---|---|---|
| JP | 2005164213 | A | * | 6/2005 | ..... F24F 1/0007 |
| JP | 2010-159909 | A | | 7/2010 | |
| JP | 2016-080207 | A | | 5/2016 | |
| JP | 2019-148353 | A | | 9/2019 | |

* cited by examiner

INDOOR UNIT FOR AIR-CONDITIONING APPARATUS AND AIR-CONDITIONING APPARATUS

CROSS REFERENCE TO RELATED APPLICATION

This application is a U.S. national stage application of PCT/JP2020/006518 filed on Feb. 19, 2020, the contents of which are incorporated herein by reference.

TECHNICAL FIELD

The present disclosure relates to an outside-air-introduction type indoor unit for an air-conditioning apparatus and an air-conditioning apparatus that includes the indoor unit.

BACKGROUND ART

Patent Literature 1 discloses an indoor unit for an air-conditioning apparatus in which an outside-air introduction box is installed in an air outlet passage so that outside air is allowed to be introduced into an air-conditioned space.

CITATION LIST

Patent Literature

Patent Literature 1: Japanese Unexamined Patent Application Publication No. 2010-159909

SUMMARY OF INVENTION

Technical Problem

In the indoor unit for an air-conditioning apparatus disclosed in Patent Literature 1, however, the installed outdoor-air introduction box narrows the air outlet passage. The narrowed air outlet passage may lead to lower air-conditioning capacity of the indoor unit.

In response to the above problem, it is an object of the present disclosure to provide an indoor unit for an air-conditioning apparatus and an air-conditioning apparatus that each allow outside air to be introduced into an air-conditioned space with little or no reduction in air-conditioning capacity of the indoor unit.

Solution to Problem

An indoor unit for an air-conditioning apparatus according to an embodiment of the present disclosure includes an outer panel that is disposed on a ceiling of an air-conditioned space and that has an air inlet and an air outlet, a fan configured to send air from the air inlet to the air outlet, a heat exchanger configured to subject air sent from the air inlet to heat exchange, an insulation box that has a space that receives the heat exchanger and the fan, an insulation panel that is disposed between the outer panel and the insulation box and that has an air inlet passage and an air outlet passage, the air inlet passage communicating between the air inlet and the space to guide air taken in through the air inlet to the heat exchanger, the air outlet passage communicating between the air outlet and the space to guide air that leaves the heat exchanger to the air outlet, and a casing to which the outer panel is attached, the casing containing the insulation box and the insulation panel. The insulation box has a first outside-air introduction passage that is located apart from the space and that is communicable with an outside of the casing. The insulation panel has a second outside-air introduction passage that is located apart from the air outlet passage and that is communicable between the first outside-air introduction passage and the air inlet passage.

An air-conditioning apparatus according to an embodiment of the present disclosure includes the above-described indoor unit.

Advantageous Effects of Invention

In the indoor unit for an air-conditioning apparatus according to an embodiment of the present disclosure, the insulation panel has the second outside-air introduction passage located apart from the air outlet passage. This configuration facilitates formation of the second outside-air introduction passage with no reduction in size of the air outlet passage. Therefore, the indoor unit for an air-conditioning apparatus according to an embodiment of the present disclosure allows outside air to be introduced into the air-conditioned space with little or no reduction in air-conditioning capacity of the indoor unit. An embodiment of the present disclosure provides such an indoor unit for an air-conditioning apparatus and an air-conditioning apparatus that includes the indoor unit.

DESCRIPTION OF EMBODIMENTS

Embodiment 1

Figure 1:
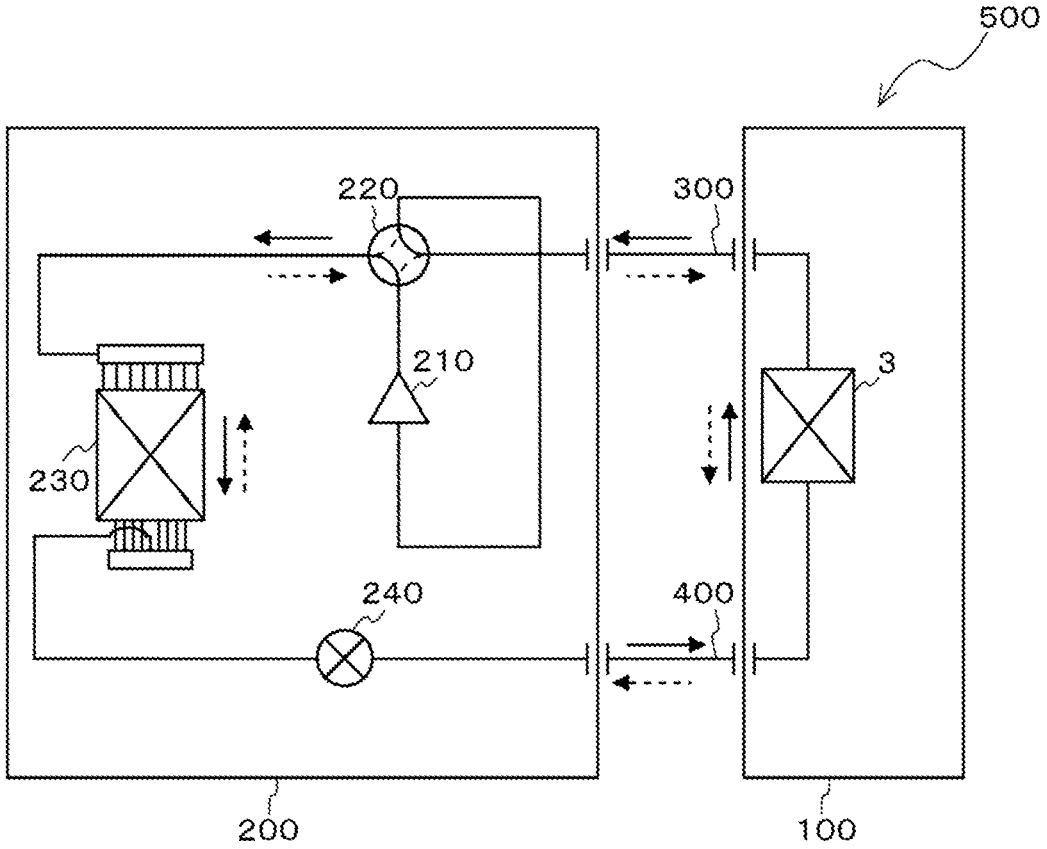
FIG. 1 is a refrigerant circuit diagram that illustrates an air-conditioning apparatus according to Embodiment 1.

An air-conditioning apparatus 500 according to Embodiment 1 is described below. FIG. 1 is a refrigerant circuit diagram that illustrates the air-conditioning apparatus 500 according to Embodiment 1. In FIG. 1, solid-line arrows represent a refrigerant flow direction in the air-conditioning apparatus 500 in a cooling operation, and dotted-line arrows represent a refrigerant flow direction in the air-conditioning apparatus 500 in a heating operation. As used herein, the term "cooling operation" refers to an operation of the air-conditioning apparatus 500 that causes low-temperature refrigerant to enter an indoor unit 100, and the term "heating operation" refers to an operation of the air-conditioning apparatus 500 that causes high-temperature refrigerant to enter the indoor unit 100. Note that the forms and relative dimensions of components in the following figures may differ from those of actual components.

The air-conditioning apparatus 500 includes the indoor unit 100 and an outdoor unit 200, which are connected by a first extension pipe 300 and a second extension pipe 400 to form a refrigerant circuit through which the refrigerant is circulated between the indoor unit 100 and the outdoor unit 200. Examples of the first extension pipe 300 and the second extension pipe 400 include existing refrigerant pipes in a building in which the air-conditioning apparatus 500 is installed. For the air-conditioning apparatus 500, the first extension pipe 300 is also called a gas refrigerant pipe, and the second extension pipe 400 is also called a liquid refrigerant pipe.

The indoor unit 100 contains a heat exchanger 3, which serves as a heat transfer device. In Embodiment 1, the heat exchanger 3 exchanges heat between air in an air-conditioned space and the refrigerant flowing inside the heat exchanger 3. The heat exchanger 3 operates as an evaporator in the cooling operation to evaporate and gasify the refrigerant. The heat exchanger 3 operates as a condenser in the heating operation to condense and liquefy the refrigerant. The structure of the indoor unit 100 and the structure of the heat exchanger 3 are described in detail later.

The outdoor unit 200 includes a compressor 210, a four-way valve 220, a heat source side heat exchanger 230, and an expansion valve 240.

The compressor 210 sucks low-temperature refrigerant, compresses the refrigerant into high-temperature refrigerant, and discharges the refrigerant. Examples of the compressor 210 include variable displacement compressors, such as a scroll compressor and a rotary compressor, in which the amount of refrigerant discharged per unit time is changed by changing an operating frequency through, for example, an inverter circuit.

The four-way valve 220 switches between internal passages for the cooling operation and internal passages for the heating operation. In FIG. 1, solid lines represent the internal passages of the four-way valve 220 for the cooling operation, and dotted lines represent the internal passages of the four-way valve 220 for the heating operation. Switching between the internal passages of the four-way valve 220 is performed in accordance with an instruction from a controller, for example. The air-conditioning apparatus 500 is configured to perform both the heating operation and the cooling operation by causing the four-way valve 220 to switch between the internal passages. If the air-conditioning apparatus 500 performs only one of the cooling operation and the heating operation, the four-way valve 220 is not necessary.

The heat source side heat exchanger 230, which is a heat transfer device, transfers and exchanges heat energy between two fluids that have different heat energy levels. A non-limiting example of the heat source side heat exchanger 230 is an air-cooled heat exchanger, such as a fin-and-tube heat exchanger, with which the refrigerant flowing inside a plurality of heat transfer tubes of the heat source side heat exchanger 230 exchanges heat with air that passes through spaces between a plurality of fins of the heat source side heat exchanger 230. The heat source side heat exchanger 230 operates as a condenser in the cooling operation to condense and liquefy the refrigerant. The heat source side heat exchanger 230 operates as an evaporator in the heating operation to evaporate and gasify the refrigerant.

The expansion valve 240 is an expansion device that expands high-pressure liquid refrigerant to reduce the pressure of the refrigerant. A non-limiting example of the expansion valve 240 is an electronic expansion valve whose opening degree is adjustable in response to an instruction from a controller, for example.

Figure 2:
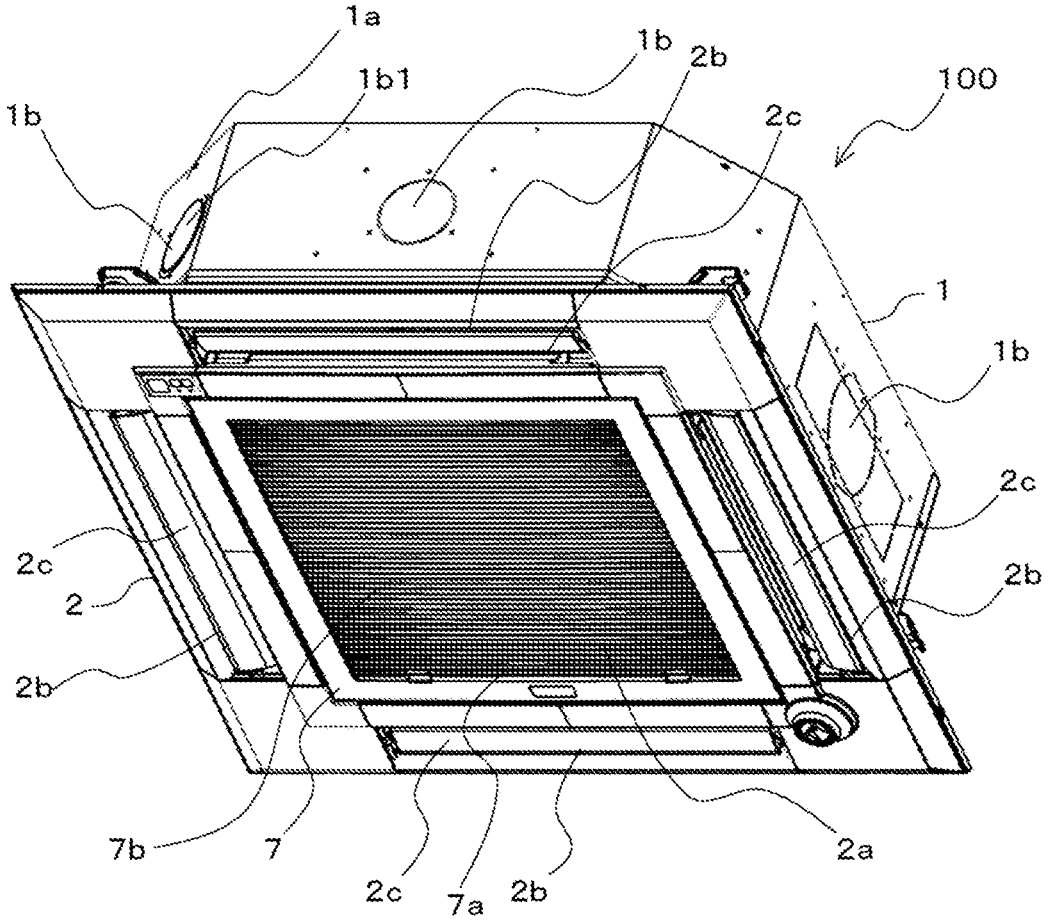
FIG. 2 is a perspective view of an indoor unit in Embodiment 1 that illustrates an example of the appearance and structure of the indoor unit.
Figure 3:
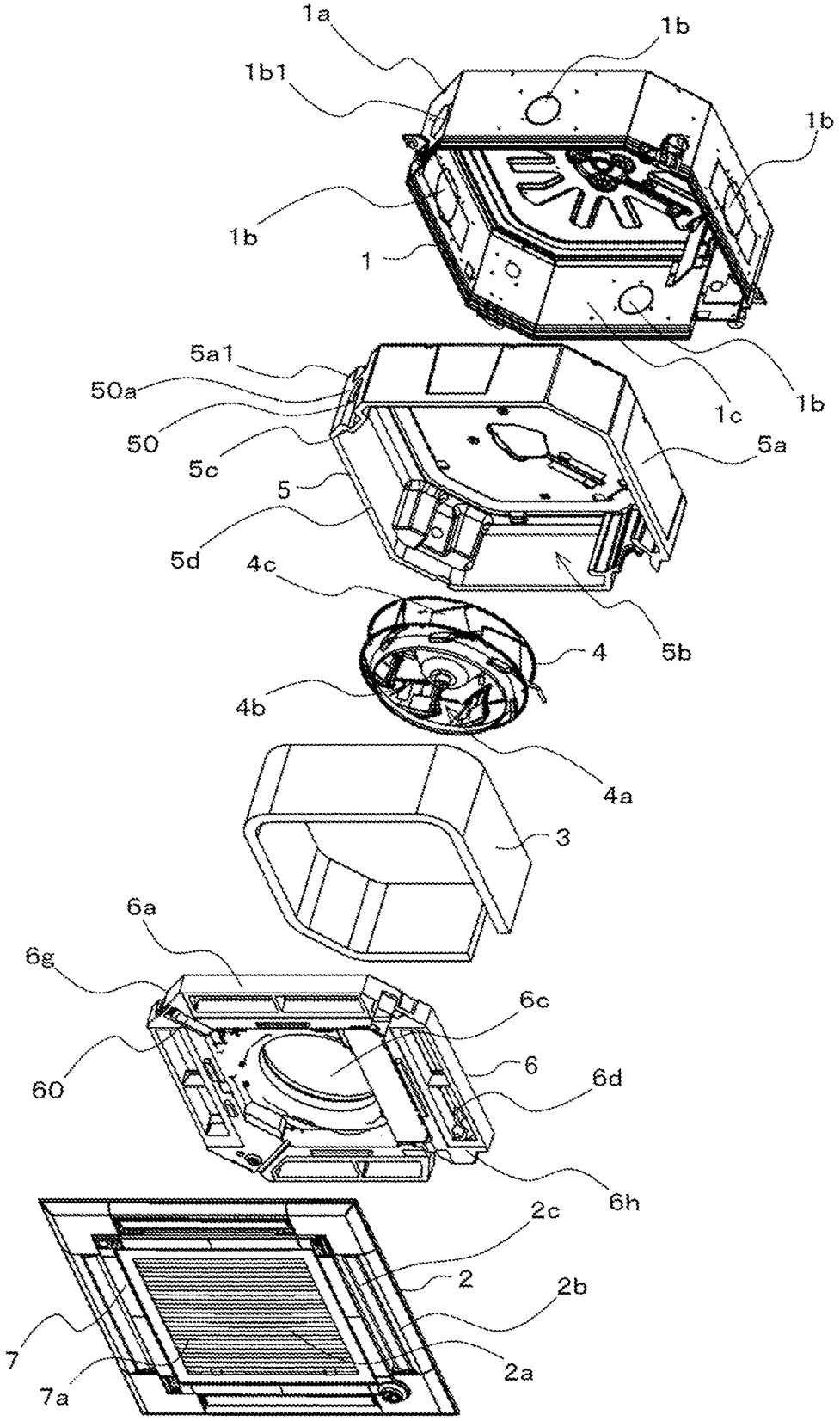
FIG. 3 is an exploded perspective view of the indoor unit illustrated in FIG. 2.

The structure of the indoor unit 100 of the air-conditioning apparatus 500 according to Embodiment 1 is described below with reference to FIGS. 2 and 3. FIG. 2 is a perspective view of the indoor unit 100 in Embodiment 1 that illustrates an example of the appearance and structure of the indoor unit 100. FIG. 3 is an exploded perspective view of the indoor unit 100 illustrated in FIG. 2. In the following figures, the same reference signs are assigned to the same elements or parts or functionally identical elements or parts. The reference signs for these elements or parts may be omitted. The positional relationship between the components of the indoor unit 100 in, for example, up-down, left-right, and front-rear directions, in principle is the positional relationship in the indoor unit 100 placed in position ready for use.

The indoor unit 100 is of a ceiling-embedded cassette type, for example. The indoor unit 100 includes a casing 1, an outer panel 2, the heat exchanger 3, a fan 4, an insulation box 5, and an insulation panel 6.

The casing 1 is made of, for example, a sheet of metal, such as stainless steel, and is disposed in a space above a ceiling. The casing 1 is a box formed in a rectangular shape by, for example, bending a metal sheet. The casing 1 opens downward. The casing 1 has flattened or chamfered corners. The flattened or chamfered corners of the casing 1 include a corner portion 1*a*. The casing 1 contains the insulation panel 6 and the insulation box 5, which accommodates the heat exchanger 3 and the fan 4.

The casing 1 has a plurality of closing panels 1*b*, which are removable from sides of the casing 1. For example, each of the closing panels 1*b* may be formed integrally with the casing 1, and may be readily removed from the casing 1 by cutting or any other processing depending on, for example, an installation environment of the indoor unit 100. Removing the closing panel 1*b* from the casing 1 forms a through-hole in the casing 1.

For example, the closing panels 1*b* include an outdoor-air introduction block panel 1*b*1 to be removed to introduce outside air into the air-conditioned space. The outside-air introduction block panel 1*b*1 may be located in the corner portion 1*a* of the casing 1. For the indoor unit 100 without introduction of outside air, the outside-air introduction block panel 1*b*1 prevents air in the space above the ceiling from being drawn into the indoor unit 100 and thus reduces or eliminates a reduction in air-conditioning capacity of the indoor unit 100. For the indoor unit 100 with introduction of outside air, the outside-air introduction block panel 1*b*1 is readily removed without the need for a worker to, for example, make a hole in the indoor unit 100 on an installation site and thus reduces on-site work.

The outside-air introduction block panel 1*b*1 may be formed integrally with the casing 1. The outside-air introduction block panel 1*b*1 integral with the casing 1 contributes to a reduction in the number of parts of the indoor unit 100 and thus reduces the number of steps of production of the indoor unit 100. The outside-air introduction block panel 1*b*1 is readily removed from the casing 1 by, for example, cutting with a cutter, such as a knife.

The outer panel 2 is made of, for example, thermoplastic resin, such as plastic, and is disposed on the ceiling of the air-conditioned space, such as a room. The outer panel 2 is closely secured to the casing 1 and the insulation panel 6 with screws or in a fitted manner, for example, in the space above the ceiling.

The outer panel 2 has an air inlet 2*a* at its central part. The air inlet 2*a* of the outer panel 2 is covered underneath with a guard panel 7, which is removable. In FIGS. 1 and 2, the guard panel 7 has, at its central part, a grille 7*a*, which has a plurality of slit-shaped air holes. The air holes of the grille 7*a* serve as the air inlet 2*a*. The guard panel 7 may have no grille 7*a*. The air inlet 2*a* of the outer panel 2 may communicate with the air-conditioned space via a space between the guard panel 7 and the outer panel 2.

The air inlet 2*a* of the outer panel 2 has a filter 7*b*. The filter 7*b* is a porous part that removes dust, bacteria, and other pollutants from the air taken in through the air inlet 2*a*. For example, the filter 7*b* is attached to the guard panel 7 to cover a downstream surface of the grille 7*a* such that the filter 7*b* is removable. The filter 7*b* may be disposed at a distance from the guard panel 7. The filter 7*b* disposed to cover the guard panel 7 is readily replaced or cleaned by detaching the guard panel 7 from the outer panel 2.

The outer panel 2 has one or more air outlets 2*b*, which are arranged around the air inlet 2*a* and communicate with the inside of the casing 1. FIGS. 1 and 2 illustrate four air outlets 2*b* arranged around the air inlet 2*a*. Alternatively, the outer panel 2 may have two air outlets 2*b* arranged across the air inlet 2*a* or may have only one air outlet 2*b*. In addition, the air outlet 2*b* may be a slit that defines a rectangular shape that surrounds the air inlet 2*a*.

The outer panel 2 has vanes 2*c* to change the direction of air to be blown from the air outlets 2*b*. Driving and rotating the vanes 2*c* adjusts the direction of air to be blown from the air outlets 2*b* in a plurality of directions that range from a direction along the ceiling to a downward direction. The vanes 2*c* are driven and rotated by, for example, a stepper motor (not illustrated).

For the heat exchanger 3, an air-cooled heat exchanger is used to exchange heat between the air taken in from the air-conditioned space and passing through the heat exchanger 3 and the refrigerant flowing inside the heat exchanger 3. A non-limiting example of the heat exchanger 3 is a fin-and-tube heat exchanger that includes a plurality of flat fins arranged parallel to each other and a plurality of heat transfer tubes that extend through the plurality of flat fins and that exchanges heat between air that passes through spaces between the adjacent flat fins and refrigerant that flows through the plurality of heat transfer tubes. In a case in which the heat exchanger 3 is a fin-and-tube heat exchanger, the plurality of heat transfer tubes of the heat exchanger 3 are arranged in a direction away from the insulation panel 6, and first ends of the plurality of flat fins are placed on the insulation panel 6. As illustrated in FIG. 3, the heat exchanger 3 has a shape formed by bending a flat heat exchanger 3 into a hollow rectangle. Alternatively, the heat exchanger 3 may have any other shape. For example, the heat exchanger 3 may include four flat heat exchanger elements 3, which define a hollow rectangle.

The fan 4 sends air from the air inlet 2*a* to the air outlets 2*b*. The fan 4 is disposed such that a suction side 4*a* of the fan 4 faces toward the grille 7*a* of the guard panel 7. The tip of a rotary shaft 4*b* of the fan 4 is pointed toward the grille 7*a* of the guard panel 7. The fan 4 includes a plurality of blades 4*c*, which are arranged around the rotary shaft 4*b*, to send air taken in through the air inlet 2*a* to the heat exchanger 3. Examples of the fan 4 include centrifugal fans, such as a multiblade sirocco fan and a turbo fan.

Figure 4:
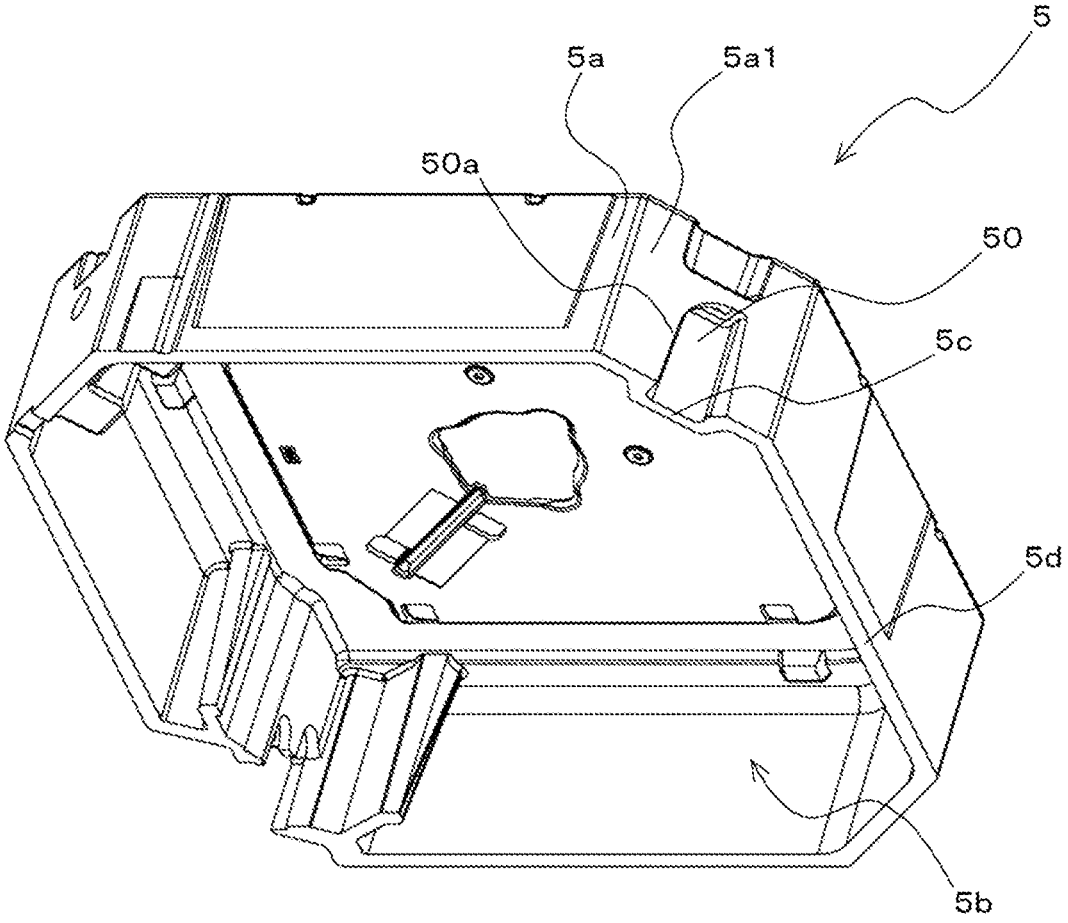
FIG. 4 is a perspective view of an insulation box as viewed from where ends of walls of the insulation box are located.

The structure of the insulation box 5 is described below with reference to FIG. 4. FIG. 4 is a perspective view of the insulation box 5 as viewed from where ends 5*d* of walls of the insulation box 5 are located.

The insulation box 5 is made of heat-insulating synthetic resin, such as expandable plastic. Examples of a material for the insulation box 5 include polystyrene foam, such as expanded polystyrene. In a case in which the insulation box 5 is made of polystyrene foam, such as expanded polystyrene, the insulation box 5 is produced by extruding melted expanded polystyrene through a prepared mold for the insulation box 5. The insulation box 5 may be produced by a known method, such as a bead foaming method that includes heating particles of, for example, polystyrene, with steam to expand the particles.

The insulation box 5 is a box that conforms in shape to inner wall surfaces 1*c* of the casing 1, as illustrated in FIG. 3. The insulation box 5 has an opening that opens downward. The insulation box 5 has outer wall surfaces 5*a*, which are tightly secured to the inner wall surfaces 1*c* of the casing 1 with a seal, such as silicone rubber, and screws, for example.

The insulation box 5 has a space 5*b* to receive the heat exchanger 3 and the fan 4, In the space 5*b* of the insulation box 5, the heat exchanger 3 is attached to the casing 1 such that the heat exchanger 3 is suspended from the casing 1 and an upper portion of the insulation box 5. In the space 5*b* of the insulation box 5, the fan 4 is attached to the casing 1 via an opening of the upper portion of the insulation box 5 with screws or other fasteners.

The space 5*b* of the insulation box 5 also serves as an air passage that allows air taken in through the air inlet 2*a* to pass through the heat exchanger 3 in response to driven rotation of the fan 4 and that guides the air subjected to heat exchange by the heat exchanger 3 to the air outlets 2*b*. The space 5*b*, which is surrounded by the heat-insulation walls, of the insulation box 5 inhibits heat energy of the air subjected to heat exchange by the heat exchanger 3 from changing because of heat transfer to the outside.

The insulation box 5 has a first outside-air introduction passage 50 located apart from the space 5*b*. The first outside-air introduction passage 50 extends along the wall of the insulation box 5 in a direction from the upper portion of the insulation box 5 to the opening of the insulation box 5. The first outside-air introduction passage 50 is separated from the space 5*b* by a partition 5*c*, which is a part of the wall of the insulation box 5, The first outside-air introduction passage 50 is a separate passage located apart from the space 5*b*. The partition 5*c* has a heat-insulating effect and thus inhibits transfer of heat energy between air that flows through the space 5*b* and outside air that flows through the first outside-air introduction passage 50.

The first outside-air introduction passage 50 may be formed as a groove-shaped passage in the outer wall surface 5*a* of the insulation box 5. For example, the first outside-air introduction passage 50 may be an outside-air inlet groove 50*a* located in the outer wall surface 5*a* of the insulation box 5, The first outside-air introduction passage 50 is located in the outer wall surface 5*a* of the insulation box 5. This configuration allows the width of the partition 5*c* to remain unchanged with no increase in width of the outer wall surface 5*a*. This configuration thus facilitates inhibition of the transfer of heat energy between the air flowing through the space 5*b* and the outside air flowing through the first outside-air introduction passage 50. This configuration therefore reduces the cost of material for the insulation box 5 and thus reduces the cost of production.

The partition 5*c* may have any cross-sectional shape in a direction perpendicular to a direction in which the outside air flows through the first outside-air introduction passage 50. For example, the cross-sectional shape of the partition 5*c* may be rectangular, semicircular, triangular, or any other shape that causes no stagnation of the outside air in the first outside-air introduction passage 50. FIG. 4 illustrates the partition 5*c* having a rectangular cross-sectional shape.

The partition 5*c* is recessed from the outer wall surface 5*a* toward the space 5*b* of the insulation box 5. The partition 5*c*, which separates the first outside-air introduction passage 50 from the space 5*b*, may have the same width as that of other parts of the wall surface of the insulation box 5. Formation of the first outside-air introduction passage 50 may cause heat energy to be transferred between the air flowing through the space 5*b* and the outside air flowing through the first outside-air introduction passage 50. However, the above-described width of the partition 5*c* inhibits such a heat energy transfer.

A part of the outer wall surface 5*a* of the insulation box 5 at which the first outside-air introduction passage 50 is located may be a corner surface Sal of the insulation box 5, which is to be in tight contact with the corner portion 1*a* of the casing 1. The first outside-air introduction passage 50 located in the corner surface Sal of the insulation box 5 allows the partition 5*c* to be located at a corner of the space 5*b* of the insulation box 5. This configuration reduces the likelihood that the partition 5*c* having a recessed form may interfere with, for example, the heat exchanger 3 or the fan 4 received in the space 5*b* of the insulation box 5 and thus leads to increased flexibility in design of the indoor unit 100.

The first outside-air introduction passage 50 is communicable with the outside of the casing 1. For example, the first outside-air introduction passage 50 may be located to open toward a wall of the casing 1 that has the outside-air introduction block panel 1*b*1 for example, the corner portion 1*a*. This configuration defines a part of a passage to introduce outside air into an indoor air-conditioned space via the indoor unit 100.

The outer wall surface 5*a* of the insulation box 5 having the outside-air inlet groove 50*a* may be tightly secured to the casing 1. For example, the outer wall surface 5*a* of the insulation box 5 may be tightly secured to the casing 1 with a seal, such as silicone rubber. This configuration reduces or eliminates leakage of the outside air flowing through the outside-air inlet groove 50*a* through a space left between the casing 1 and the insulation box 5 and thus reduces or eliminates, for example, noise caused by the air flowing through the space and a reduction in air-conditioning capacity caused by the air flowing through the space into the space 5*b* of the insulation box 5.

Figure 5:
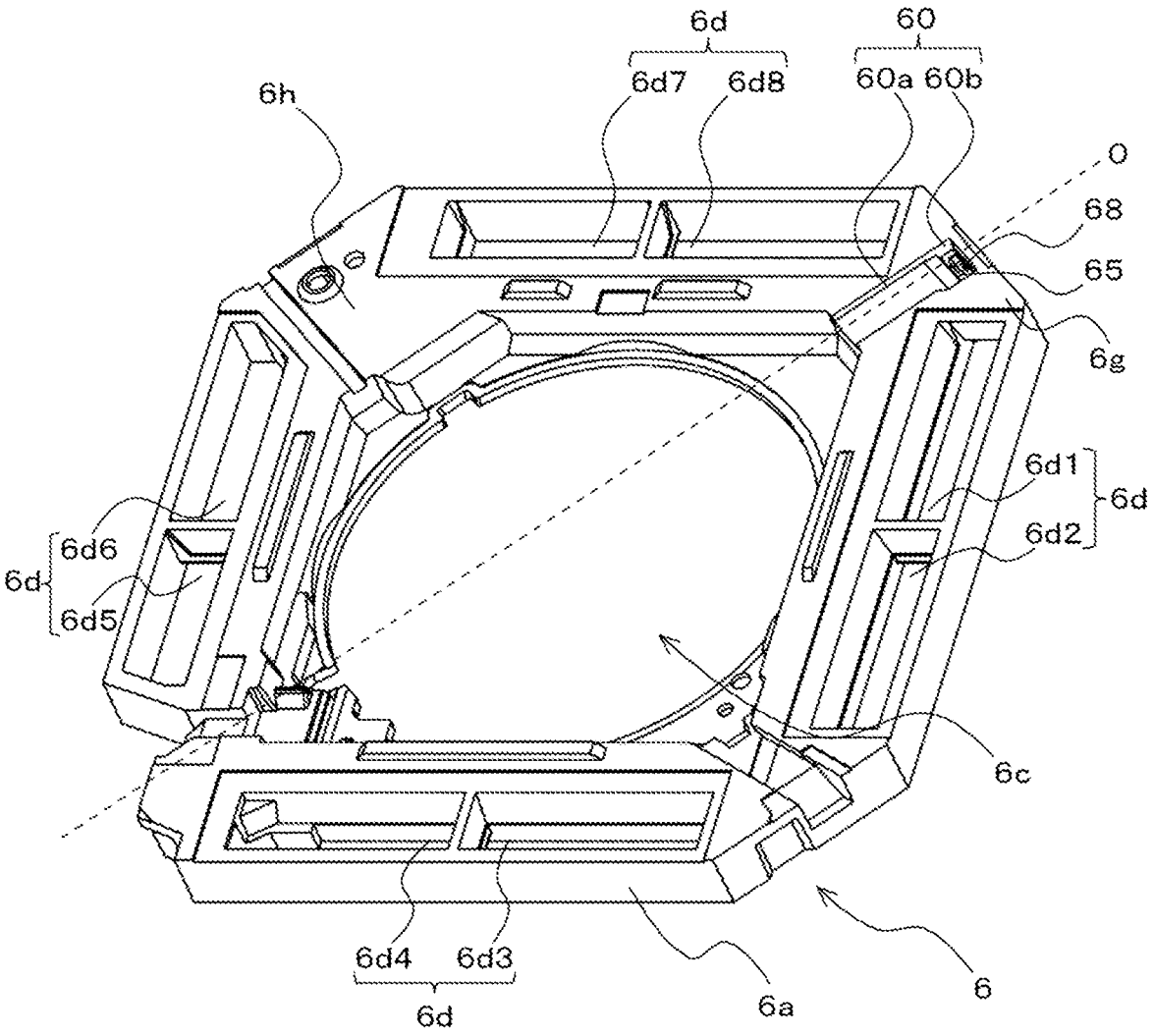
FIG. 5 is a perspective view of an insulation panel as viewed from where a lower surface of the insulation panel is located.
Figure 6:
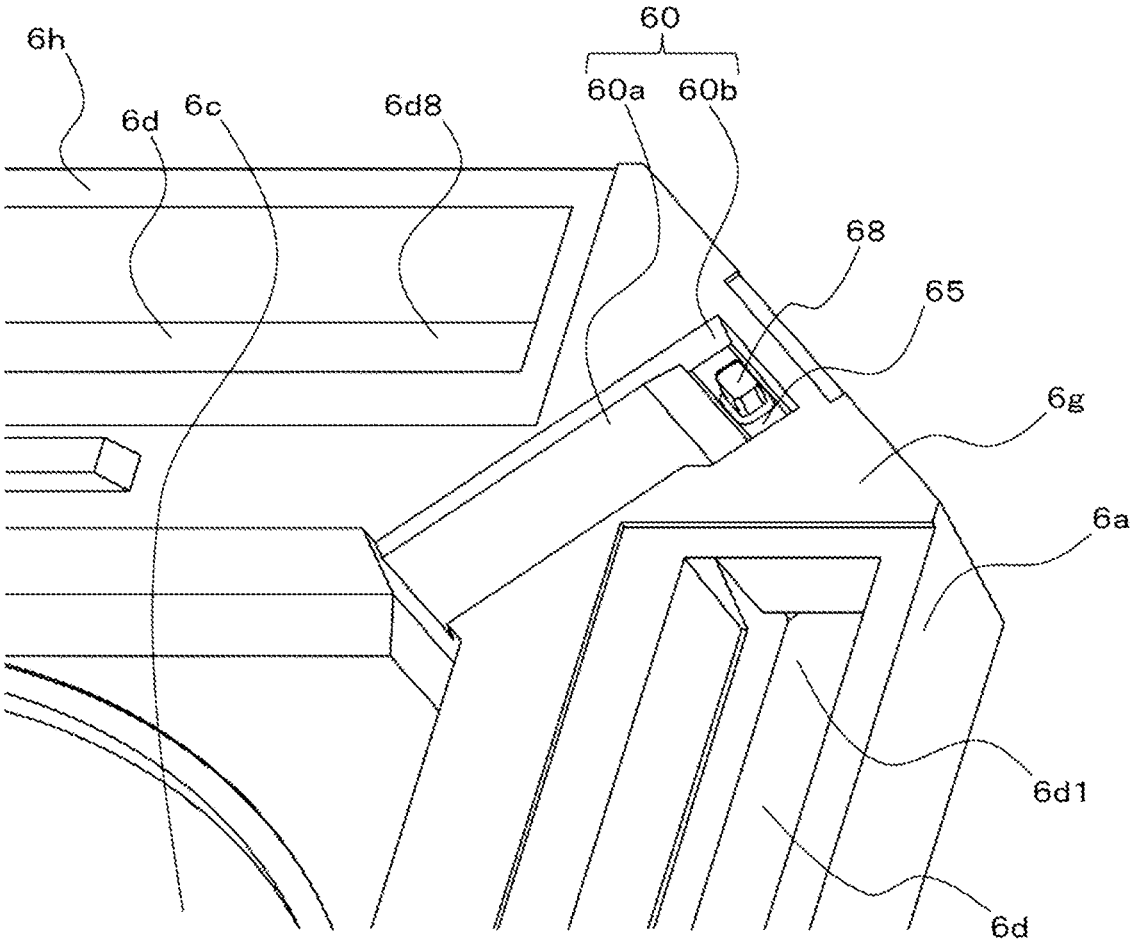
FIG. 6 is a partial enlarged view of the insulation panel illustrated in FIG. 5.
Figure 7:
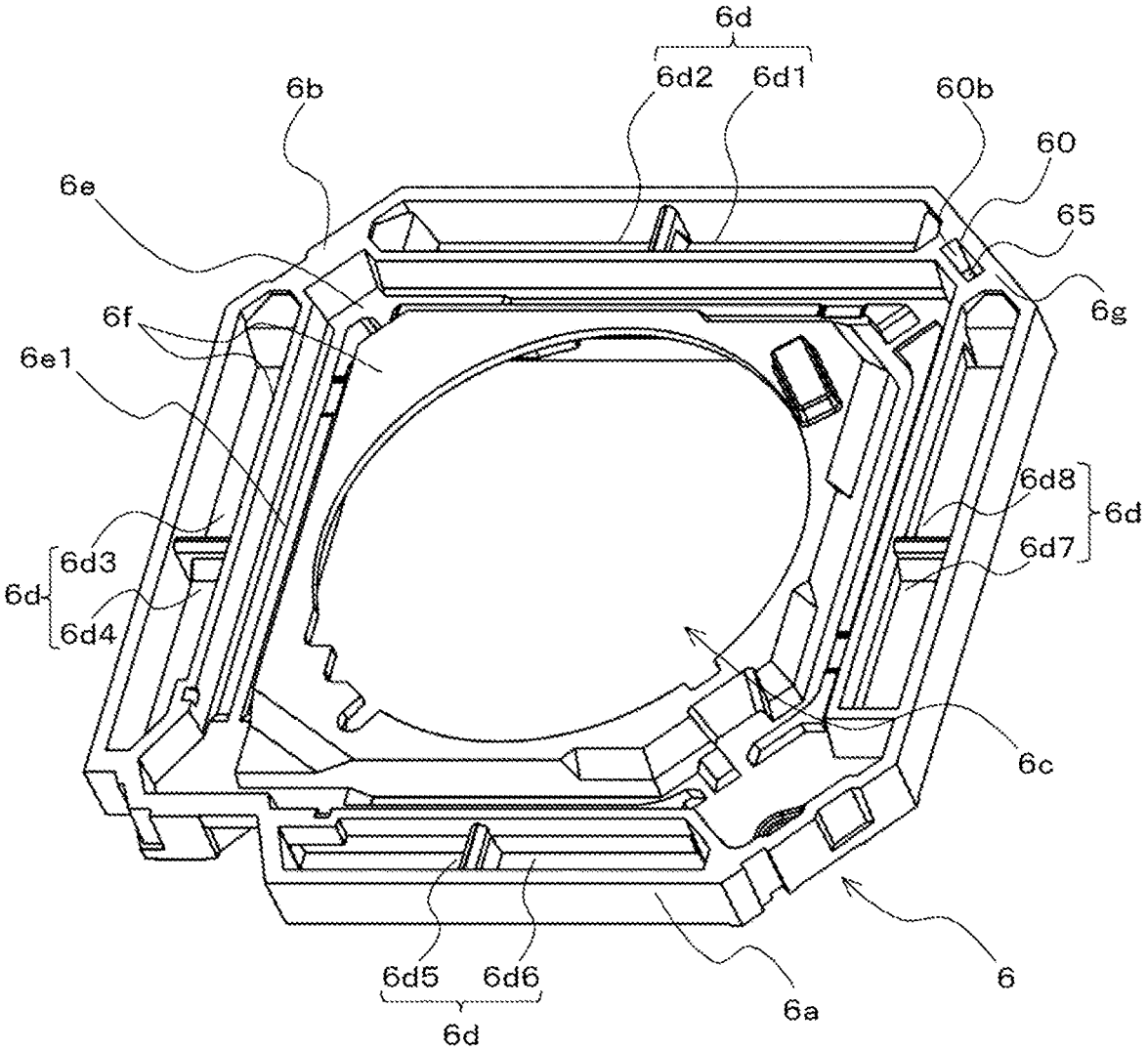
FIG. 7 is a perspective view of the insulation panel as viewed from where an upper surface of the insulation panel is located.
Figure 8:
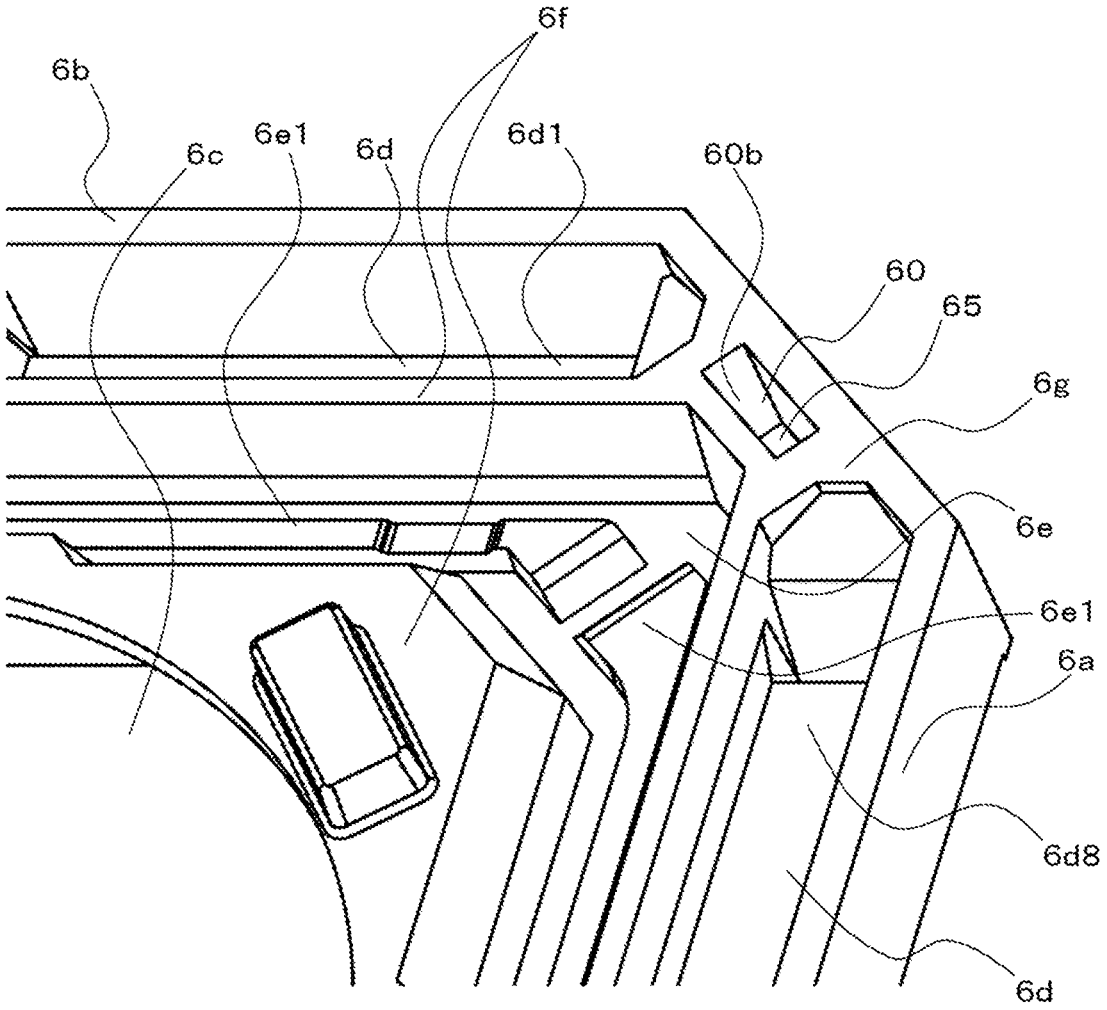
FIG. 8 is a partial enlarged view of the insulation panel illustrated in FIG. 7.
Figure 9:
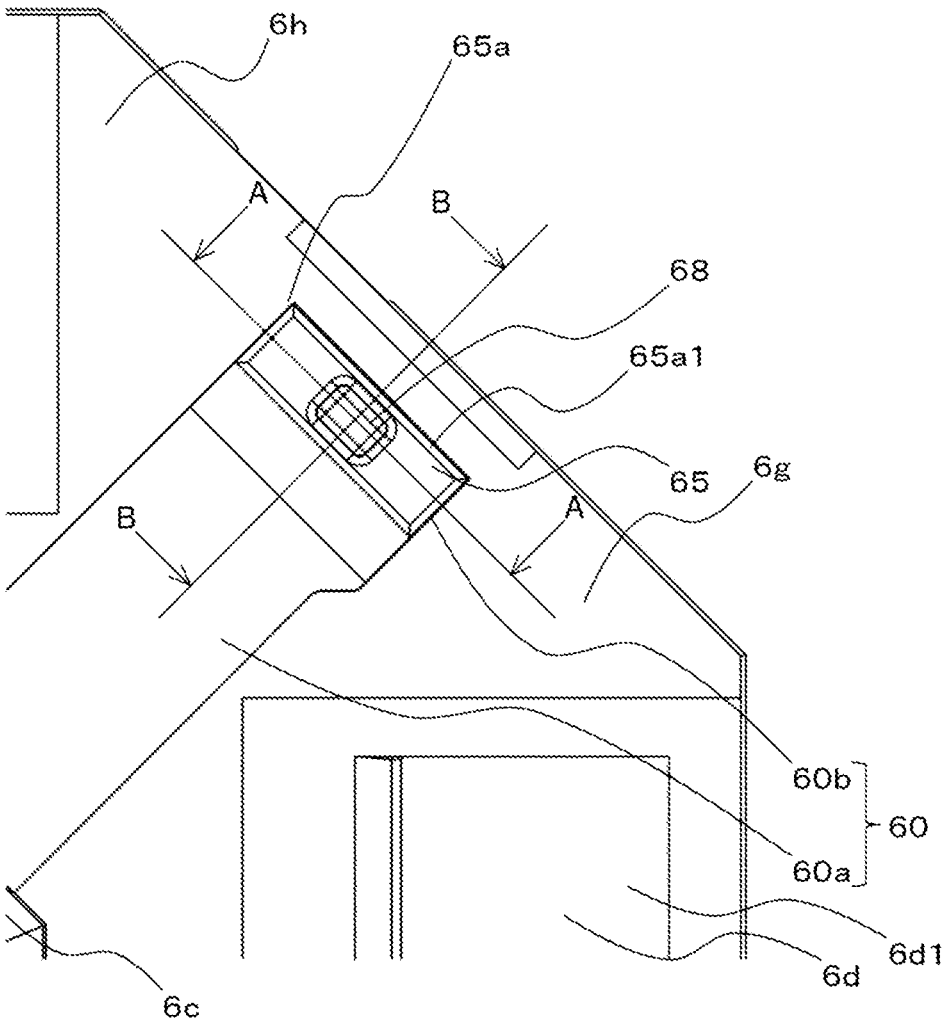
FIG. 9 is a plan view of a part of the lower surface of the insulation panel illustrated in FIG. 6.
Figure 10:
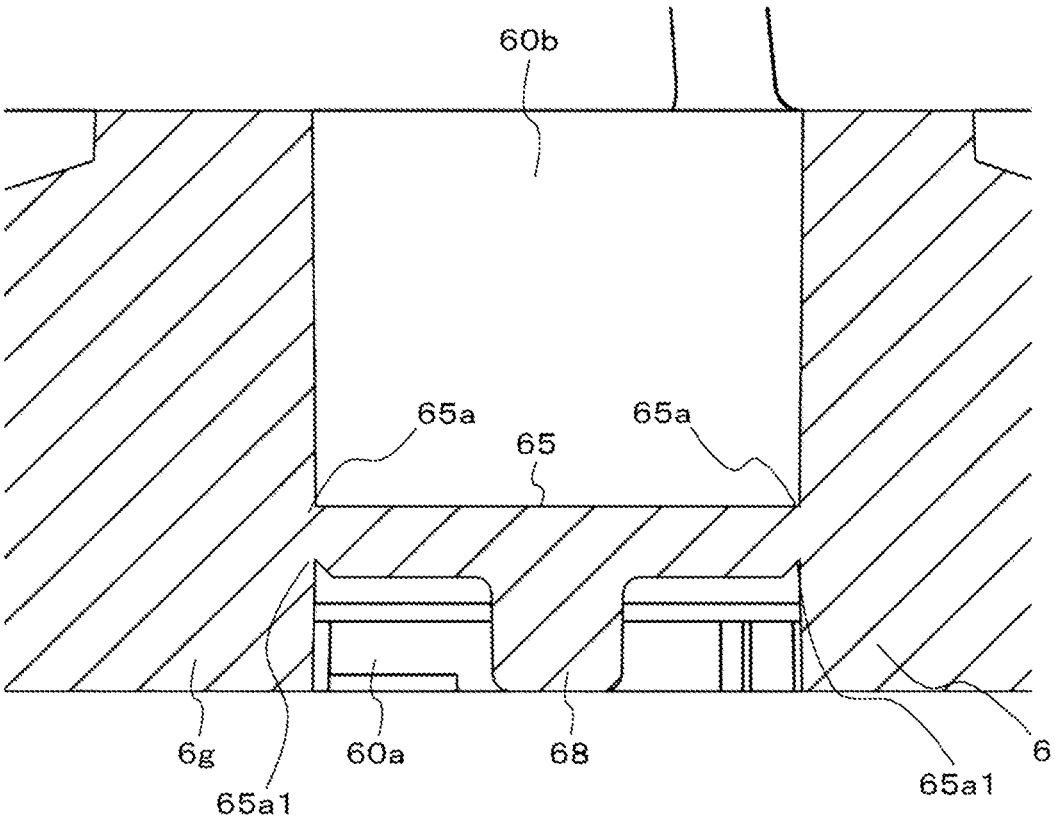
FIG. 10 is a sectional view taken along line A-A in FIG. 9.
Figure 11:
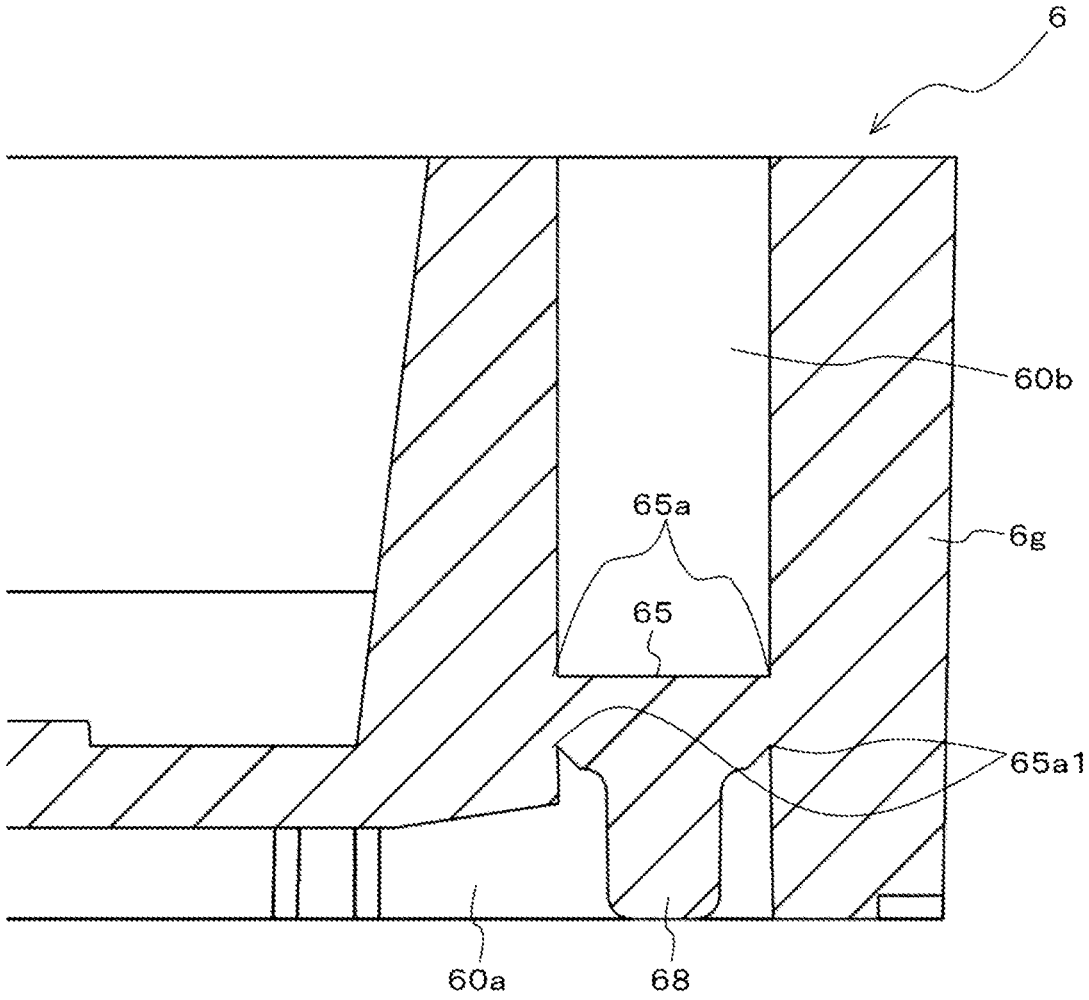
FIG. 11 is a sectional view taken along line B-B in FIG. 9.

The structure of the insulation panel 6 is described below with reference to FIGS. 5 to 11. FIG. 5 is a perspective view of the insulation panel 6 as viewed from where a lower surface 6*h* is located. FIG. 6 is a partial enlarged view of the insulation panel 6 illustrated in FIG. 5. FIG. 7 is a perspective view of the insulation panel 6 as viewed from where an upper surface 6*b* is located. FIG. 8 is a partial enlarged view of the insulation panel 6 illustrated in FIG. 7. FIG. 9 is a plan view of a part of the lower surface 6*h* of the insulation panel 6 illustrated in FIG. 6. FIG. 10 is a sectional view taken along line A-A in FIG. 9. FIG. 11 is a sectional view taken along line B-B in FIG. 9. FIG. 7 corresponds to an image of the insulation panel illustrated in FIG. 5 rotated about an axis O by 180 degrees.

The insulation panel 6 is an inner panel to be disposed between the outer panel 2 and the insulation box 5. Similarly to the insulation box 5, the insulation panel 6 is made of heat-insulating synthetic resin, such as expandable plastic. For example, the insulation panel 6 is produced by extruding melted expanded polystyrene through a prepared mold for the insulation panel 6. The insulation panel 6 has side faces 6*a*, which conform in shape to the inner wall surfaces 1*c* of the casing 1. The side faces 6*a* are tightly secured to the inner wall surfaces 1*c* of the casing 1 with, for example, a seal, such as silicone rubber, and screws. The upper surface 6*b* of the insulation panel 6 is tightly secured to the ends 5*d* of the walls of the insulation box 5 with a seal, for example.

Figure 16:
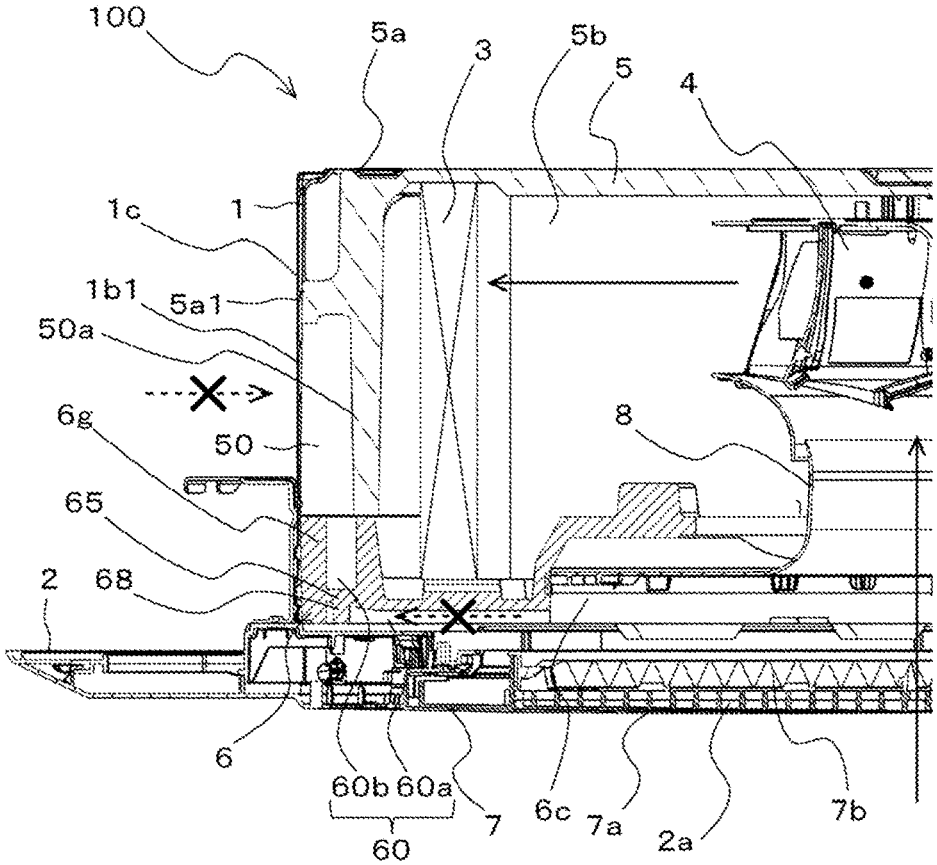
FIG. 16 is a sectional view taken along line C-C in FIG. 15.

The insulation panel 6 has an air inlet passage 6*c*. The air inlet passage 6*c* is a through-hole to communicate between the air inlet 2*a* of the outer panel 2 and the space 5*b* of the insulation box 5. For example, the air inlet passage 6*c* is a circular through-hole in a central part of the insulation panel 6. The air inlet passage 6*c* guides air taken in through the air inlet 2*a* to the heat exchanger 3 via the fan 4. The insulation panel 6 may have a bell-mouthed flared duct 8, as illustrated in FIG. 16, which is described later. The flared duct 8 located at the insulation panel 6 allows the air inlet passage 6*c* to efficiently guide air to the heat exchanger 3. The flared duct 8 may be formed as a part separate from the insulation panel 6 or may be formed integrally with the insulation panel 6 by molding.

The insulation panel 6 has air outlet passages 6*d*. The air outlet passages 6*d* are through-holes that communicate between the air outlets 2*b* of the outer panel 2 and the space 5*b* of the insulation box 5. The air outlet passages 6*d* include separate rectangular distribution passages 6*d*1 to 6*d*8, each of which is a through-hole that communicates between the corresponding one of the air outlets 2*b* of the outer panel 2 and the space 5*b* of the insulation box 5. The distribution passages 6*d*1 to 6*d*8 are located around the air inlet passage 6*c* such that two distribution passages are arranged for each of the four air outlets. For example, the distribution passages 6*d*1 and 6*d*2, the distribution passages 6*d*3 and 6*d*4, the distribution passages 6*d*5 and 6*d*6, and the distribution passages 6*d*7 are 6*d*8 are pairs of two through-holes that each communicate with the corresponding one of the four air outlets 2*b*. The number of distribution passages 6*d*1 to 6*d*8 communicating with one air outlet 2*b* is not limited to two. One or three or more distribution passages may communicate with one air outlet 2*b*.

The insulation panel 6 has a water receiving groove 6*e*. The water receiving groove 6*e* serves as a drain pan to accumulate water that is generated and drips from the heat exchanger 3. The water accumulated in the water receiving groove 6*e* is discharged to the outside of the indoor unit 100 by a drain pump (not illustrated), for example.

For example, the water receiving groove 6*e* may be formed in air passage walls 6*f*, which surround the air inlet passage 6*c* and separate the air inlet passage 6*c* from the air outlet passages 6*d*. The water receiving groove 6*e* has, on its bottom, a rib 6*e*1 to support lower parts of the heat exchanger 3, The water receiving groove 6*e* may have a plurality of ribs 6*e*1 depending on the shape of the heat exchanger 3. For example, FIG. 7 illustrates a plurality of elongated ribs 6*e*1, which extend along the water receiving groove 6*e*. The water receiving groove 6*e* and the ribs 6*e*1 are formed by, for example, placing a water-repellent coating material on a portion of the mold for the insulation panel 6 that corresponds to the water receiving groove 6*e* and extruding melted expanded polystyrene through the mold.

The indoor unit 100 may include the insulation panel 6 having neither water receiving groove 6*e* nor ribs 6*e*1. For example, the indoor unit 100 may include a drain pan separate from the insulation panel 6, and the drain pan may have the water receiving groove 6*e* and the ribs 6*e*1.

The insulation panel 6 has a second outside-air introduction passage 60 to introduce outside air to the air inlet passage 6*c*. The second outside-air introduction passage 60 is located in the insulation panel 6 and is communicable between the first outside-air introduction passage 50 and the air inlet passage 6*c*.

The second outside-air introduction passage 60 is located apart from the air outlet passages 6*d* in the insulation panel 6. Since the second outside-air introduction passage 60 is located apart from the air outlet passages 6*d* in the insulation panel 6, the second outside-air introduction passage is formed without narrowing the air outlet passages 6*d*. Thus, the second outside-air introduction passage 60 located apart from the air outlet passages 6*d* in the insulation panel 6 allows the indoor unit 100 to introduce outside air into the air-conditioned space with little or no reduction in air-conditioning capacity.

The second outside-air introduction passage 60 in the insulation panel 6 does not communicate with the air outlet passages 6*d* and the water receiving groove 6*e*. For example, the second outside-air introduction passage 60 and the plurality of distribution passages 6*d*1 to 6*d*8 are spaced apart from each other around the air outlet passages 6*d* and the water receiving groove 6*e*. In FIG. 5, the second outside-air introduction passage 60 is located in a corner portion 6*g* of the insulation panel 6, which is to be in tight contact with the corner portion 1*a* of the casing 1 and that separates the distribution passage 6*d*1 from the distribution passage 6*d*8.

The second outside-air introduction passage 60 may include, for example, an outside-air outlet groove 60*a*, which is a groove-shaped air passage that communicates with the air inlet passage 6*c*, located in the lower surface 6*h* of the insulation panel 6. The lower surface 6*h* of the insulation panel 6 is a surface of the insulation panel 6 that faces the outer panel 2. The outside-air outlet groove 60*a* opens toward the outer panel 2.

The outside-air outlet groove 60*a* is located in the lower surface 6*h* of the insulation panel 6. This configuration facilitates inhibition of the transfer of heat energy between the air flowing through the space 5*b* and the outside air flowing through the second outside-air introduction passage 60 with no increase in thickness of the insulation panel 6 in the up-down direction. Furthermore, the outside-air outlet groove 60*a* located in the lower surface 6*h* of the insulation panel 6 allows the water receiving groove 6*e* to be located in the upper surface 6*b* of the insulation panel 6 with no increase in thickness of the insulation panel 6 in the up-down direction. Therefore, the outside-air outlet groove 60*a* located in the lower surface 6*h* of the insulation panel 6 leads to a reduction in the cost of material for the insulation panel 6 and thus reduces the cost of production.

The outside-air outlet groove 60*a* may have any cross-sectional shape in the direction perpendicular to a direction in which the outside air flows through the outside-air outlet groove 60*a*. For example, the cross-sectional shape of the outside-air outlet groove 60*a* may be rectangular, semicircular, triangular, or any other shape that causes no stagnation of outside air in the outside-air outlet groove 60*a*, FIGS. 5 and 6 illustrate the outside-air outlet groove 60*a* having a rectangular cross-sectional shape.

The lower surface 6*h*, which has the outside-air outlet groove 60*a*, of the insulation panel 6 may be tightly secured to the outer panel 2. The lower surface 6*h* of the insulation panel 6 may be tightly secured to the outer panel 2 with, for example, a seal, such as silicone rubber. For example, a seal located around the outside-air outlet groove 60*a*, a seal located around the air inlet passage 6*c*, and a seal located around each of the air outlet passages 6*d* on the lower surface 6*h* of the insulation panel 6 reduce or eliminate leakage of air from the outside-air outlet groove 60*a*, the air inlet passage 6*c*, and the air outlet passages 6*d*. Therefore, the lower surface 6*h* of the insulation panel 6 tightly secured to the outer panel 2 reduces or eliminates mixture of air between the outside-air outlet groove 60*a* and the air outlet passages 6*d* and mixture of air between the air inlet passage 6*c* and the air outlet passages 6*d* and thus reduces or eliminates, for example, a reduction in air-conditioning capacity of the indoor unit 100.

The second outside-air introduction passage 60 may include a communication path 60*b*, which is communicable between the outside-air outlet groove 60*a* and the first outside-air introduction passage 50. For example, the communication path 60*b* may be formed as a hole that is communicable between the outside-air outlet groove 60*a* and the first outside-air introduction passage 50. The communication path 60*b* formed as a hole-shaped air passage allows a smaller amount of seal to be used for reducing or eliminating leakage of air from the communication path 60*b* than the communication path 60*b* formed as a groove-shaped air passage.

For example, the communication path 60*b* may be located at the corner portion 6*g*, which separates the distribution passage 6*d*1 from the distribution passage 6*d*8, of the insulation panel 6. Since the communication path 60*b* is located at the corner portion 6*g* of the insulation panel 6, the communication path 60*b*, through which the outside air from the first outside-air introduction passage 50 passes, is formed in the insulation panel 6 with no reduction in opening area of the air outlet passages 6*d* that includes the distribution passages 6*d*1 and 6*d*8. Therefore, the communication path 60*b* located at the corner portion 6*g* of the insulation panel 6 reduces or eliminates a reduction in air that passes through the air outlet passages 6*d* in the indoor unit 100.

Since the communication path 60*b* is located at the corner portion 6*g* of the insulation panel 6, the communication path 60*b* is spaced apart from the air outlet passages 6*d*. Spacing the communication path 60*b* apart from the air outlet passages 6*d* reduces or eliminates the likelihood that the heat energy of the air passing through the air outlet passages 6*d* may increase or decrease because of heat transfer between the outside air passing through the communication path 60*b* and the air passing through the air outlet passages 6*d*. Therefore, the communication path 60*b* located at the corner portion 6*g* of the insulation panel 6 reduces or eliminates, for example, a reduction in air-conditioning capacity of the indoor unit 100.

The hole of the communication path 60*b* may have any shape as long as the communication path 60*b* is communicable between the outside-air outlet groove 60*a* and the first outside-air introduction passage 50. For example, the hole of the communication path 60*b* may be rectangular, circular, polygonal, or any other shape that causes no stagnation of the outside air in the communication path 60*b*. FIGS. 7 and 8 illustrate the communication path 60*b* having a rectangular hole.

The insulation panel 6 includes an air-passage block lid 65 located in the second outside-air introduction passage 60. The air-passage block lid 65 is located in the second outside-air introduction passage 60 and is removable from the insulation panel 6. For example, the air-passage block lid 65 is integral with the insulation panel 6. The air-passage block lid 65 integral with the insulation panel 6 contributes to a reduction in the number of parts that form the insulation panel 6 and thus reduces the cost of production of the indoor unit 100. The air-passage block lid 65 integral with the insulation panel 6 is molded from expandable plastic, such as expanded polystyrene. This configuration facilitates removal processing, such as cutting and thus increases the efficiency of removing the air-passage block lid 65.

The air-passage block lid 65 is a block wall that blocks communication between the air inlet passage 6*c* and the first outside-air introduction passage 50. For example, the air-passage block lid 65 may be located in the communication path 60*b*. The air-passage block lid 65 located in the communication path 60*b* is easily removed by moving the edge of a cutter, such as a knife, along a wall surface of the communication path 60*b*. This configuration further increases the efficiency of removing the air-passage block lid 65.

The insulation panel 6 has a marker that designates an outer edge 65*a* of the air-passage block lid 65 that is adjacent to the outside-air outlet groove 60*a*. For example, the marker may be made to designate the outer edge 65*a* of the air-passage block lid 65 by using, for example, a pen, or may be a cut groove 65*a*1, which defines the outer edge 65*a* of the air-passage block lid 65. Since the insulation panel 6 has the marker designating the outer edge 65*a* of the air-passage block lid 65 adjacent to the outside-air outlet groove 60*a*, a target cut position for removing the air-passage block lid 65 is easily identified visually. Therefore, the marker designating the outer edge 65*a* of the air-passage block lid 65 allows the air-passage block lid 65 to be removed appropriately.

In particular, the cut groove 65*a*1, which defines the outer edge 65*a* of the air-passage block lid 65 adjacent to the outside-air outlet groove 60*a*, in the insulation panel 6 allows the edge of a cutter, such as a knife, to be moved along the cut groove 65*a*1 without being deviated from the cut groove 65*a*1. Furthermore, since the insulation panel 6 has the cut groove 65*a*1, which defines the outer edge 65*a* of the air-passage block lid 65 adjacent to the outside-air outlet groove 60*a*, the target cut position for removing the air-passage block lid 65 is easily identified visually. Therefore, the cut groove 65*a*1, which defines the outer edge 65*a* of the air-passage block lid 65 adjacent to the outside-air outlet groove 60*a*, in the insulation panel 6 allows the air-passage block lid 65 to be removed more appropriately and efficiently.

FIG. 9 illustrates the cut groove 65*a*1 extending along the entire perimeter of the outer edge 65*a* of the air-passage block lid 65. Alternatively, the cut groove 65*a*1 may be located at a part of the outer edge 65*a* of the air-passage block lid 65. In addition, the cut groove 65*a*1 may have any cross-sectional shape in a direction perpendicular to a direction in which the cut groove 65*a*1 extends. For example, the cross-sectional shape of the cut groove 65*a*1 may be rectangular, semicircular, triangular, or any other shape that allows the edge of a cutter, such as a knife, to be moved along the cut groove 65*a*1 without being deviated from the cut groove 65*a*1. FIGS. 10 and 11 illustrate the cut groove 65*a*1 having a triangular cross-sectional shape.

The insulation panel 6 includes a knob 68 located on a surface of the air-passage block lid 65 that is adjacent to the outside-air outlet groove 60*a*. Since the knob 68 is located on the surface of the air-passage block lid 65 adjacent to the outside-air outlet groove 60*a*, the air-passage block lid 65 is readily removed from the insulation panel 6 when the knob 68 is pulled toward the outside-air outlet groove 60*a* after the outer edge 65*a* of the air-passage block lid 65 is cut with a cutter, such as a knife. Therefore, the knob 68 located on the surface of the air-passage block lid 65 adjacent to the outside-air outlet groove 60*a* allows the air-passage block lid 65 to be removed more efficiently.

For example, the knob 68 is integral with the air-passage block lid 65. The knob 68 integral with the air-passage block lid 65 contributes to a reduction in the number of parts that form the insulation panel 6 and thus reduces the cost of production of the indoor unit 100.

The knob 68 may have any shape. For example, the shape of the knob 68 may be a polygonal prism, a cylinder, a polygonal pyramid, a cone, a dome, or any other shape that allows the knob 68 to be pinched by, for example, fingers of an on-site worker or a work tool, such as pliers. FIGS. 10 and 11 illustrate the knob 68 having a chamfered and rectangular prismatic shape.

The structure and operations of the indoor unit 100 without introduction of outside air into the air-conditioned space is described below with reference to FIGS. 12 to 16.

Figure 12:
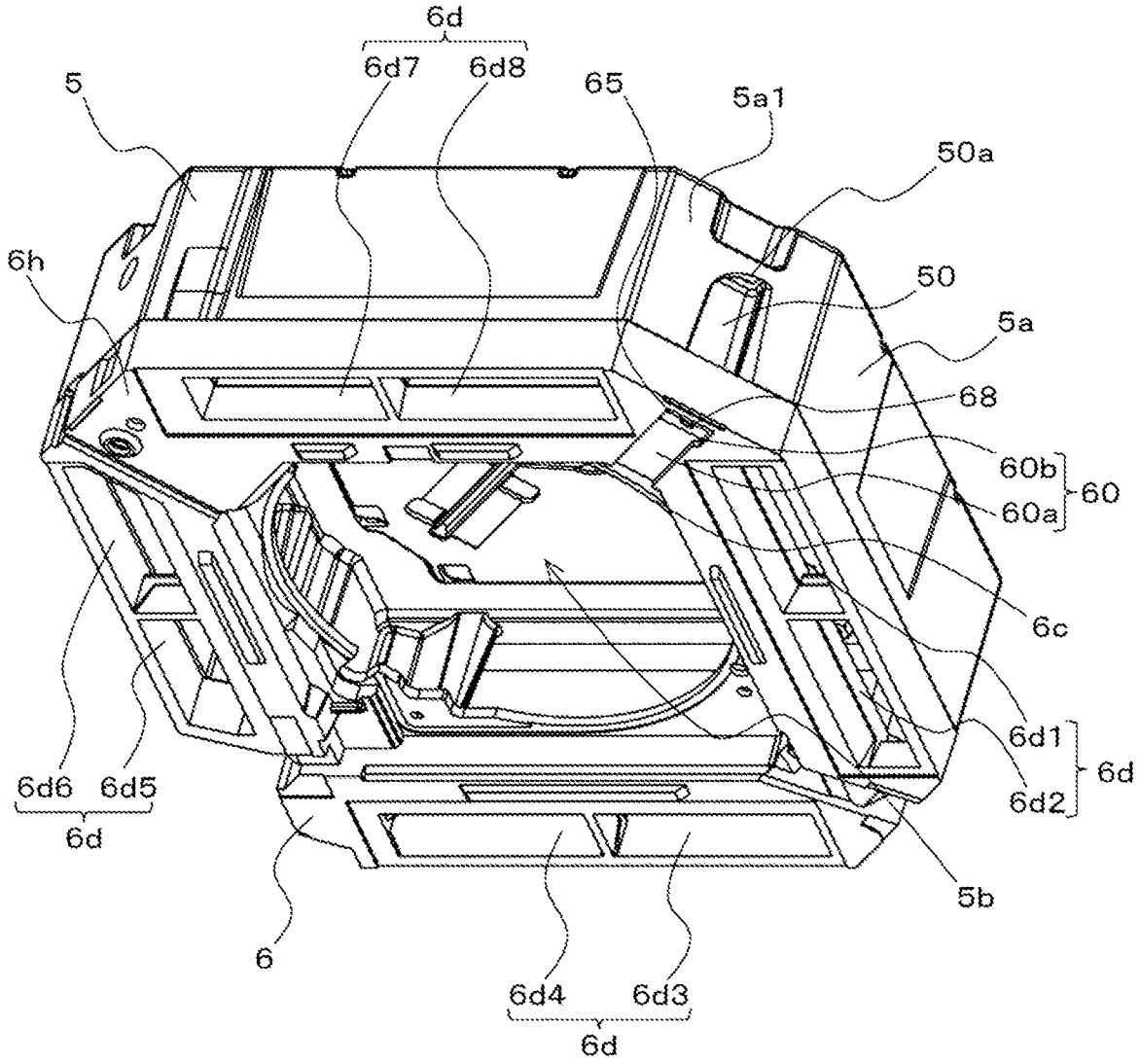
FIG. 12 is a perspective view of the insulation box and the insulation panel combined with each other.
Figure 13:
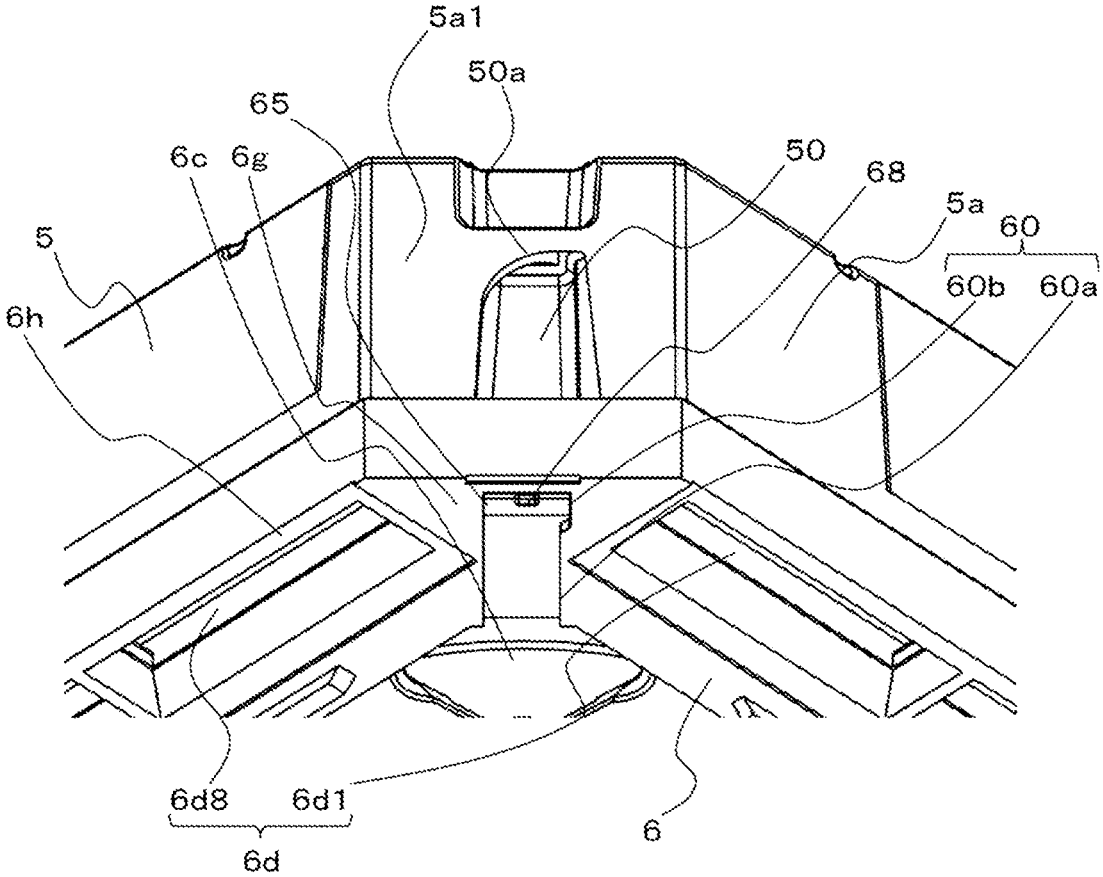
FIG. 13 is s partial enlarged view of FIG. 12.
Figure 14:
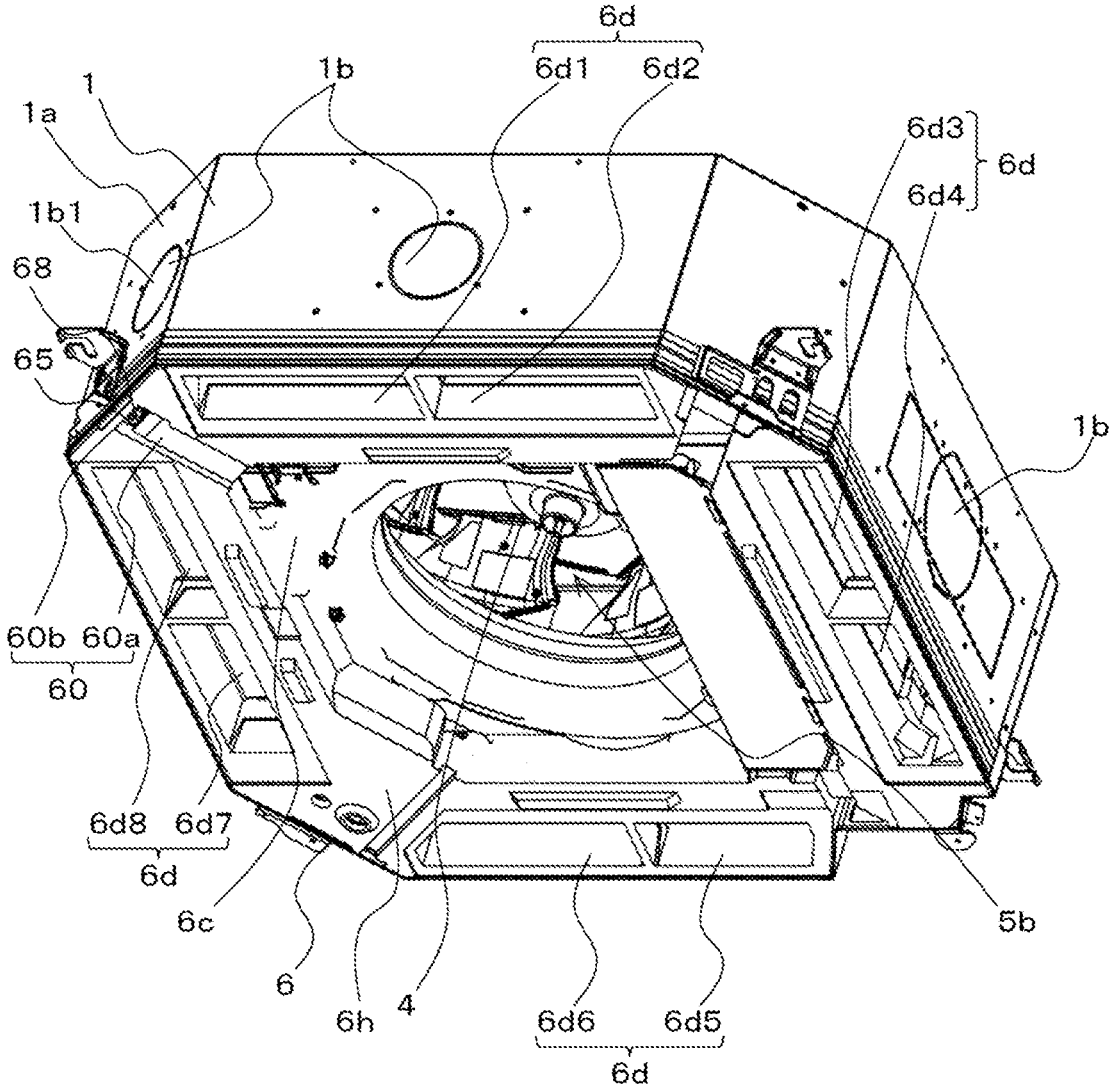
FIG. 14 is a perspective view of the insulation box and the insulation panel illustrated in FIG. 12 and a casing combined with each other.
Figure 15:
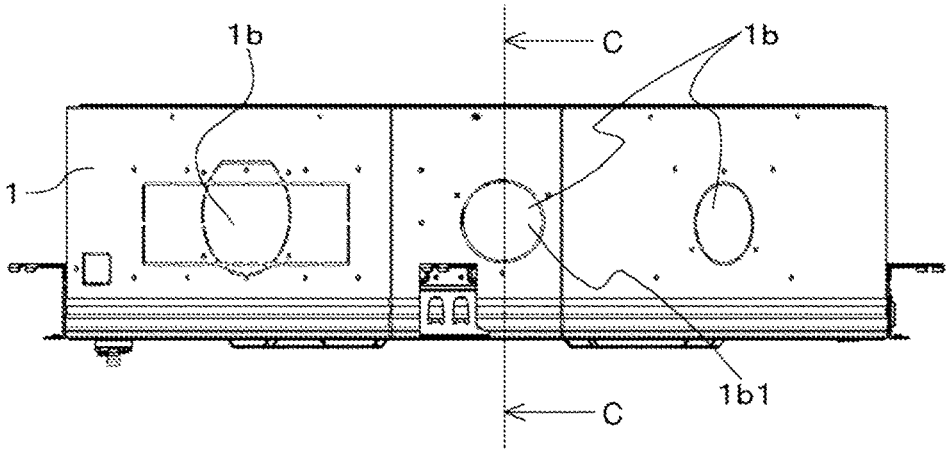
FIG. 15 is a front external view that illustrates an outside-air introduction block panel illustrated in FIG. 14.

FIG. 12 is a perspective view of the insulation box 5 and the insulation panel 6 combined with each other. FIG. 13 is a partial enlarged view of FIG. 12. FIG. 14 is a perspective view of the insulation box 5 and the insulation panel 6 illustrated in FIG. 12 and the casing 1 combined with each other. FIG. 15 is a front external view that illustrates the outside-air introduction block panel 1*b*1 illustrated in FIG. 14. FIG. 16 is a sectional view taken along line C-C in FIG. 15. In FIG. 16, solid-line arrows schematically represent a flow of air during driving of the indoor unit 100, and dashed-line arrows with crosses schematically represent directions in which the flow of air is blocked or inhibited.

The insulation box 5 and the insulation panel 6 are tightly secured to each other with, for example, a seal, such as silicone rubber. Securing the insulation box 5 and the insulation panel 6 tightly to each other couples the first outside-air introduction passage 50 located in the insulation box 5 to the second outside-air introduction passage 60 located in the insulation panel 6 with each other. As described above, for example, the upper surface 6*b* of the insulation panel 6 is tightly secured to the ends 5*d* of the walls of the insulation box 5. Securing the insulation box 5 and the insulation panel 6 tightly to each other inhibits the air flowing through the space 5*b* of the insulation box 5 from leaking from a space between the upper surface 6*b* of the insulation panel 6 and the ends 5*d* of the walls of the insulation box 5 and thus reduces or eliminates a reduction in air-conditioning capacity of the indoor unit 100.

For the insulation box 5 and the insulation panel 6 tightly secured to each other, the outer wall surfaces 5*a* of the insulation box 5 and the side faces 6*a* of the insulation panel 6 are tightly secured to the inner wall surfaces 1*c* of the casing 1 with, for example, screws or a seal, such as silicone rubber. Securing the casing 1 tightly to the insulation box 5 and the insulation panel 6 causes the first outside-air introduction passage 50, which is the outside-air inlet groove 50*a* located in the corner surface 5*a*1 of the insulation box 5, to face and be closed by the outside-air introduction block panel 1*b*1 located in the corner portion 1*a* of the casing 1. In the casing 1 tightly secured to the insulation box 5 and the insulation panel 6, therefore, the first outside-air introduction passage 50 is a closed space defined by the corner portion 1*a* of the casing 1 having the outside-air introduction block panel 1*b*1 and the air-passage block lid 65 located in the second outside-air introduction passage 60. This configuration inhibits the air outside the casing 1 with the outside-air introduction block panel 1*b*1 from entering the first outside-air introduction passage 50.

In the example described below, the indoor unit 100 with the outside-air introduction block panel 1*b*1 and the air-passage block lid 65 is driven.

In response to driving the indoor unit 100, the fan 4 is rotated and thus causes air in the air-conditioned space to be drawn into the space 5*b* of the insulation box 5 via the air inlet 2*a* of the outer panel 2, the air inlet passage 6*c* of the insulation panel 6, and the flared duct 8. The drawn air in the space 5*b* of the insulation box 5 is sent to the heat exchanger 3 by rotation of the fan 4. In the heat exchanger 3, the air sent by the fan 4 and passing through the heat exchanger 3 exchanges heat with the refrigerant flowing inside the heat exchanger 3. The rotation of the fan 4 causes the air subjected to heat exchange in the heat exchanger 3 to be sent to the air outlets 2*b* of the outer panel 2 via the air outlet passages 6*d* of the insulation panel 6. The air is then blown into the air-conditioned space from the air outlets 2*b* of the outer panel 2.

In response to driving the indoor unit 100, the air passing through the air inlet passage 6*c* of the insulation panel 6 may scatter and partly enter the outside-air outlet groove 60*a* of the second outside-air introduction passage 60. The second outside-air introduction passage 60, however, has the air-passage block lid 65 in the communication path 60*b*. This configuration inhibits the air from entering the first outside-air introduction passage 50 via the second outside-air introduction passage 60. Therefore, the air-passage block lid 65 located in the second outside-air introduction passage 60 reduces or eliminates a reduction in flow rate of the air to be drawn into the space 5*b* of the insulation box 5 caused by the first outside-air introduction passage 50 and the second outside-air introduction passage 60 and thus reduces or eliminates a reduction in air-conditioning capacity of the indoor unit 100.

The casing 1, which is made of a metal sheet, may vibrate under the pressure of air that enters the first outside-air introduction passage 50 and thus may cause noise. The air-passage block lid 65 in the second outside-air introduction passage 60 inhibits the air from entering the first outside-air introduction passage 50 and thus reduces the likelihood that the indoor unit 100 may generate noise.

The structure and operations of the indoor unit 100 with introduction of outside air into the air-conditioned space is described below with reference to FIGS. 17 to 24.

Figure 17:
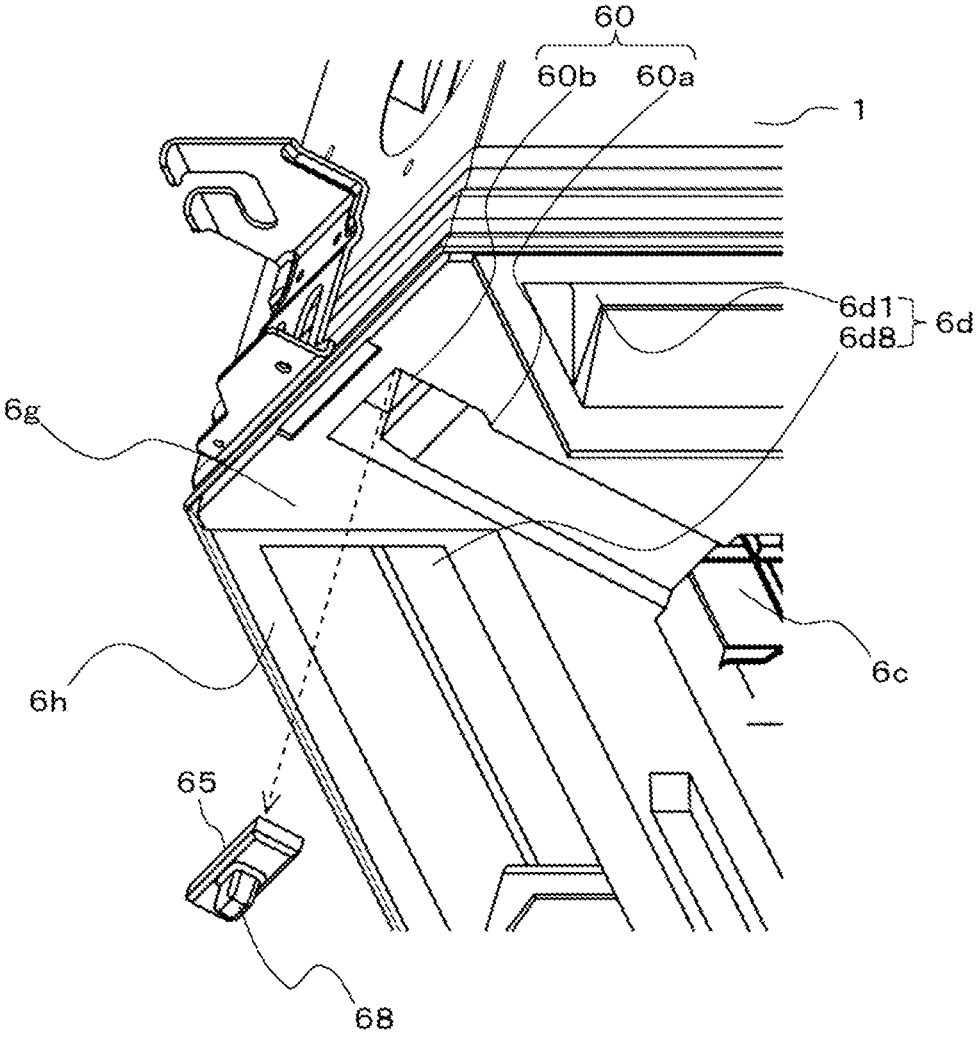
FIG. 17 is a schematic enlarged perspective view that illustrates the insulation panel illustrated in FIG. 14 with an air-passage block lid and a knob removed.
Figure 18:
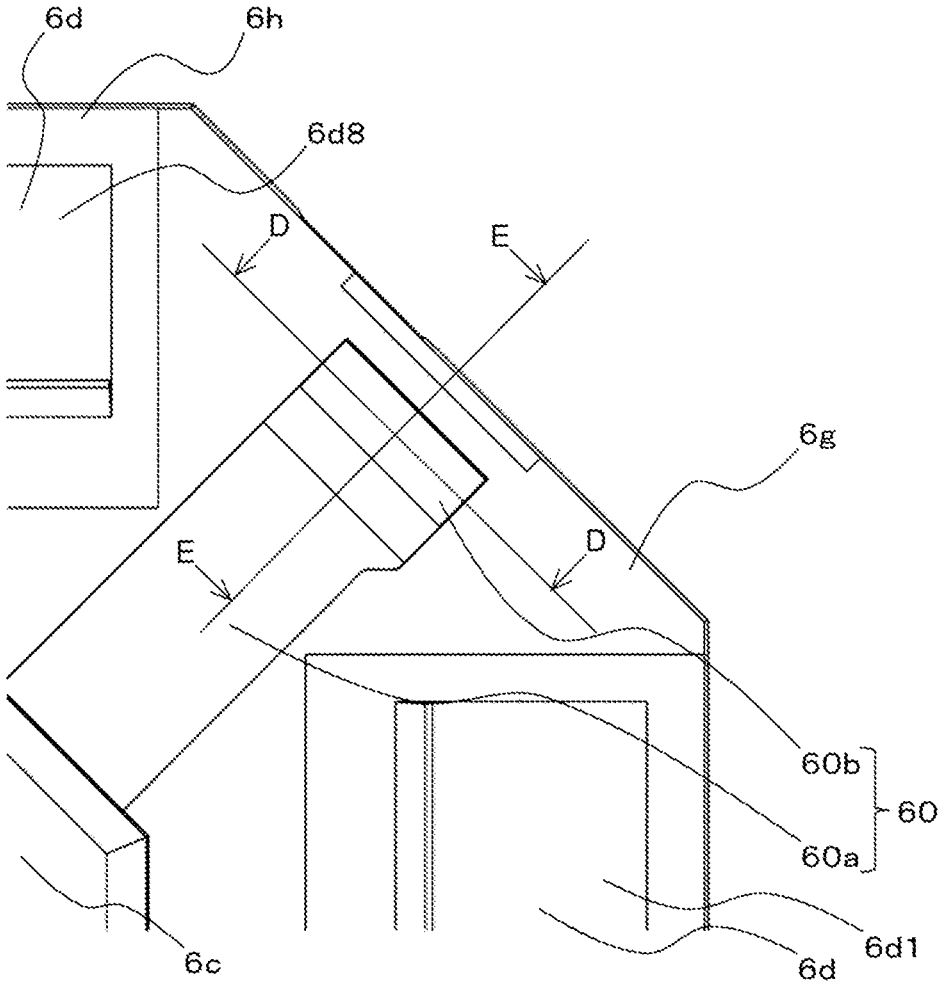
FIG. 18 is a plan view of a part of the lower surface of the insulation panel illustrated in FIG. 17.
Figure 19:
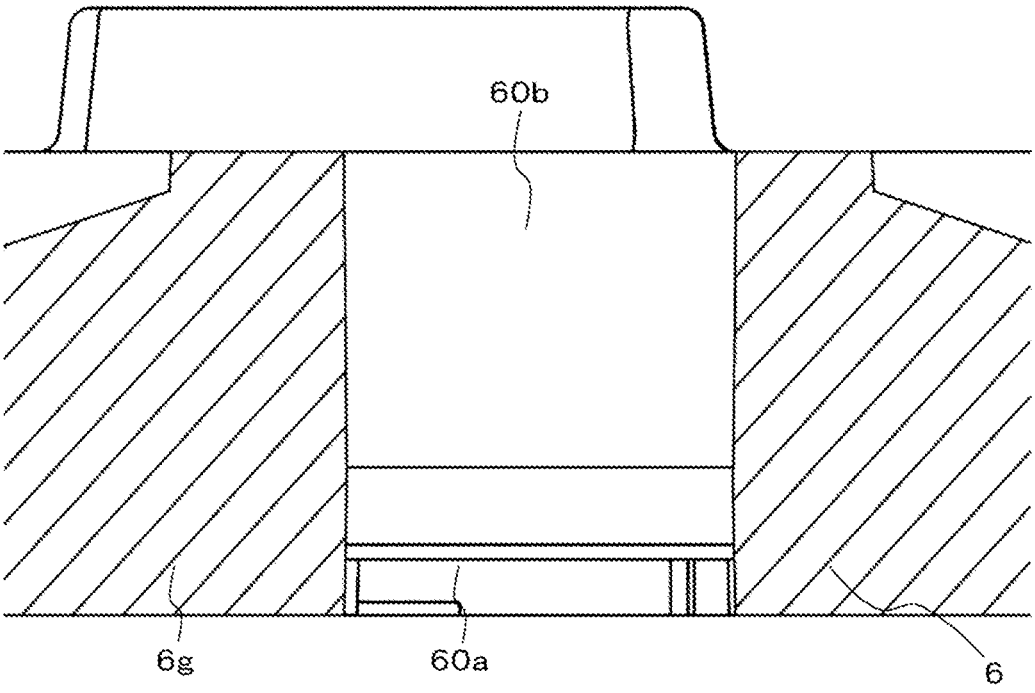
FIG. 19 is a sectional view taken along line D-D in FIG. 18.
Figure 20:
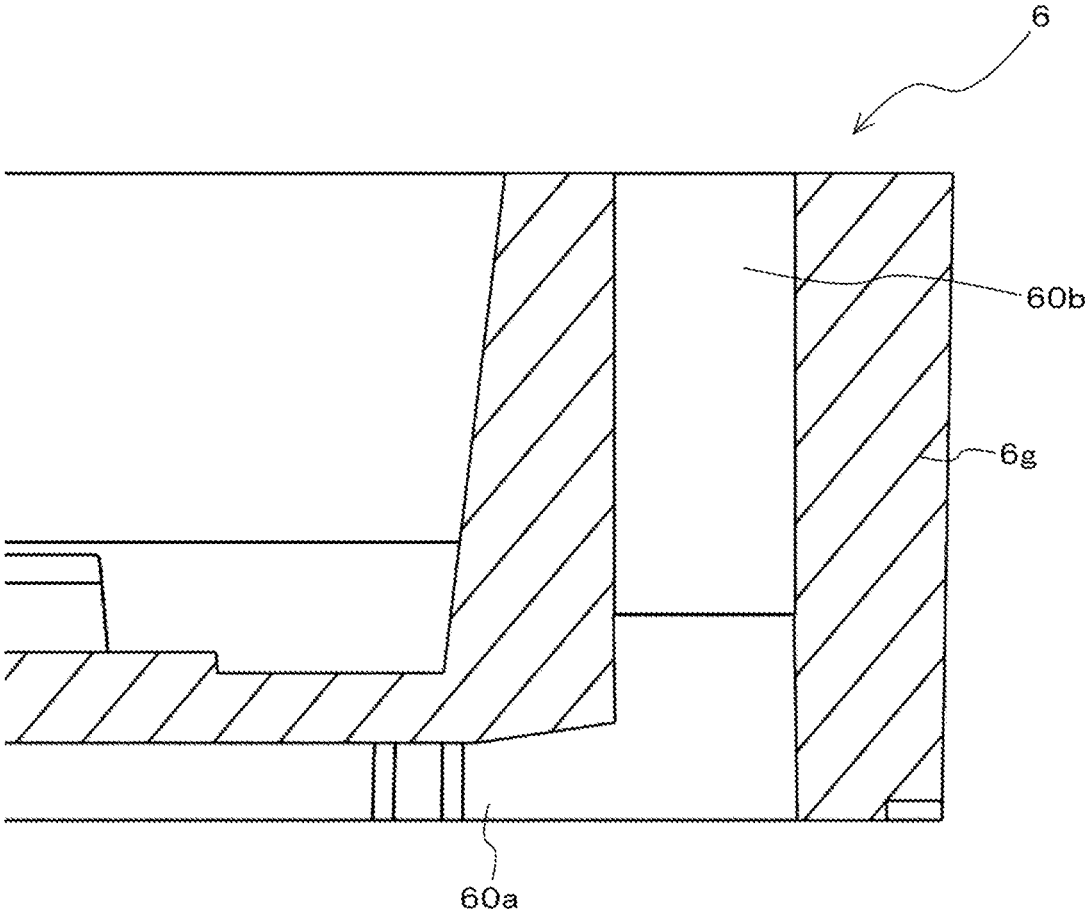
FIG. 20 is a sectional view taken along line E-E in FIG. 18.
Figure 21:
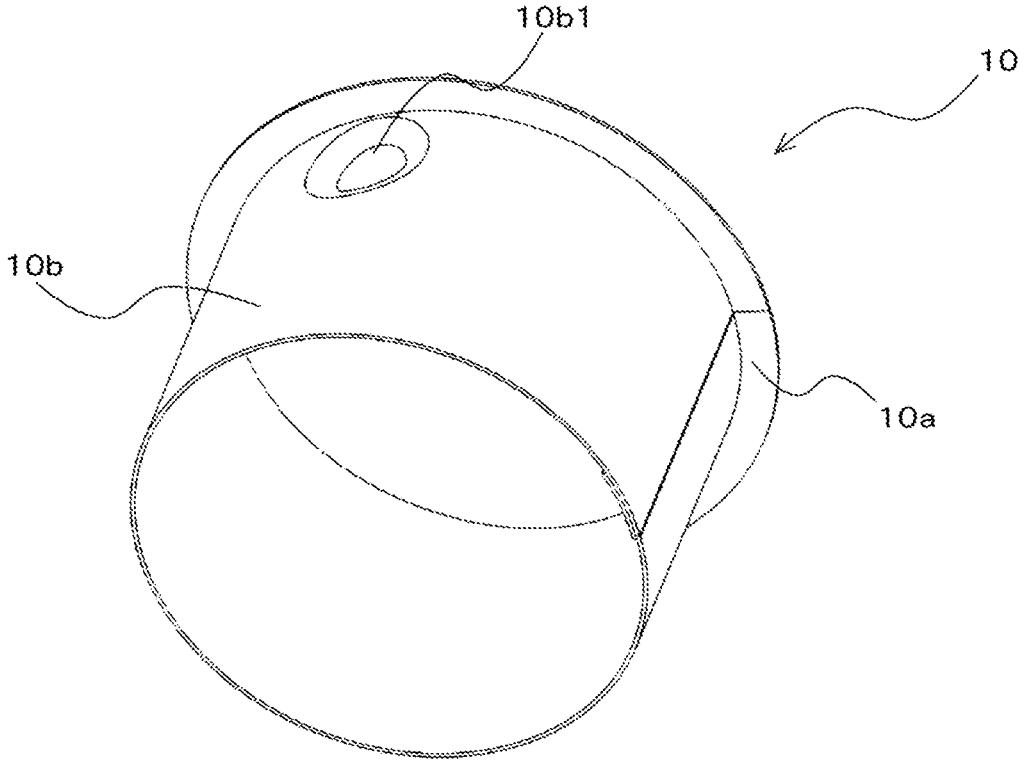
FIG. 21 is a perspective view of a duct flange that illustrates the appearance and structure of the duct flange.
Figure 22:
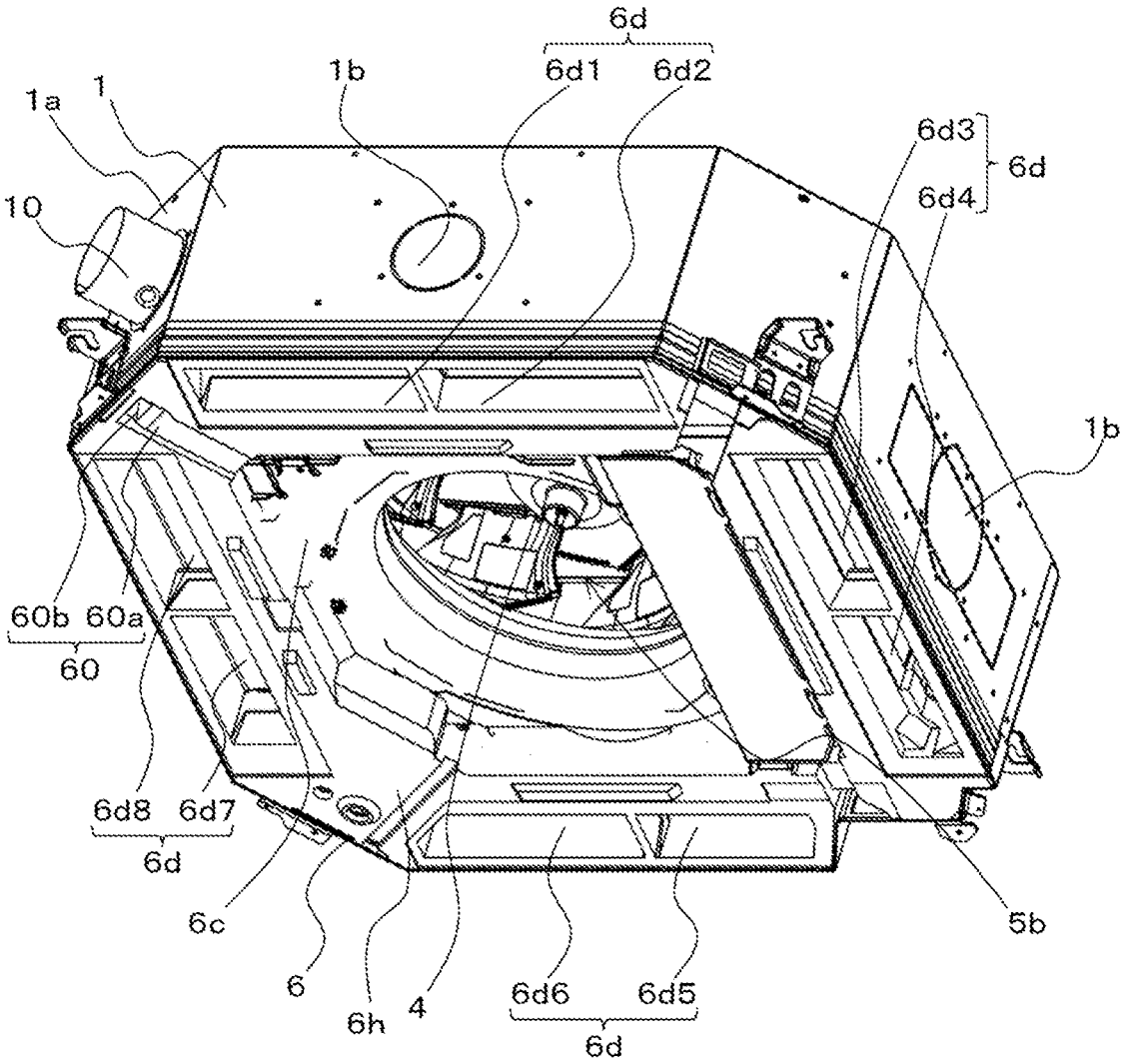
FIG. 22 is a perspective view of the indoor unit illustrated in FIG. 17 with the duct flange attached.
Figure 23:
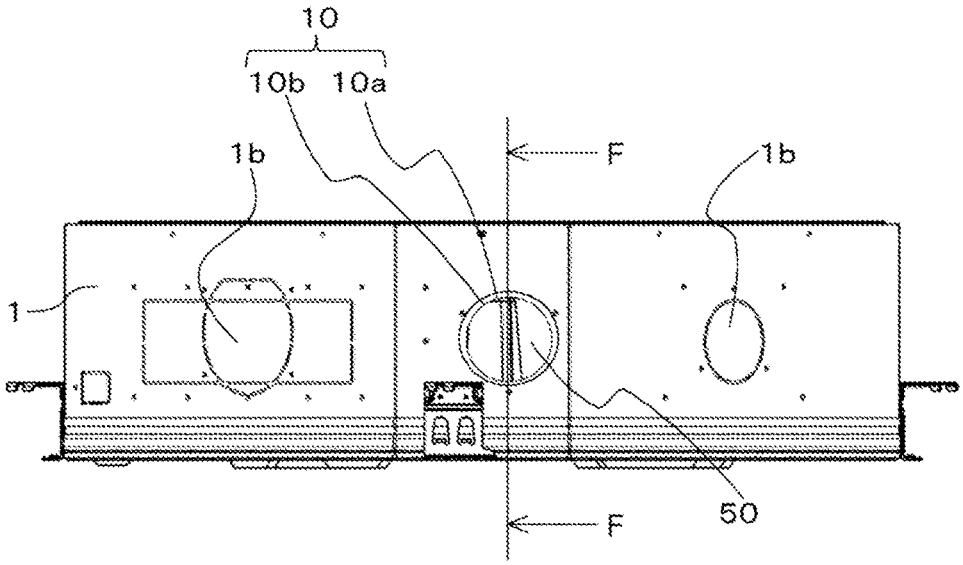
FIG. 23 is a front view that illustrates the duct flange illustrated in FIG. 22 as viewed from where outside air enters.
Figure 24:
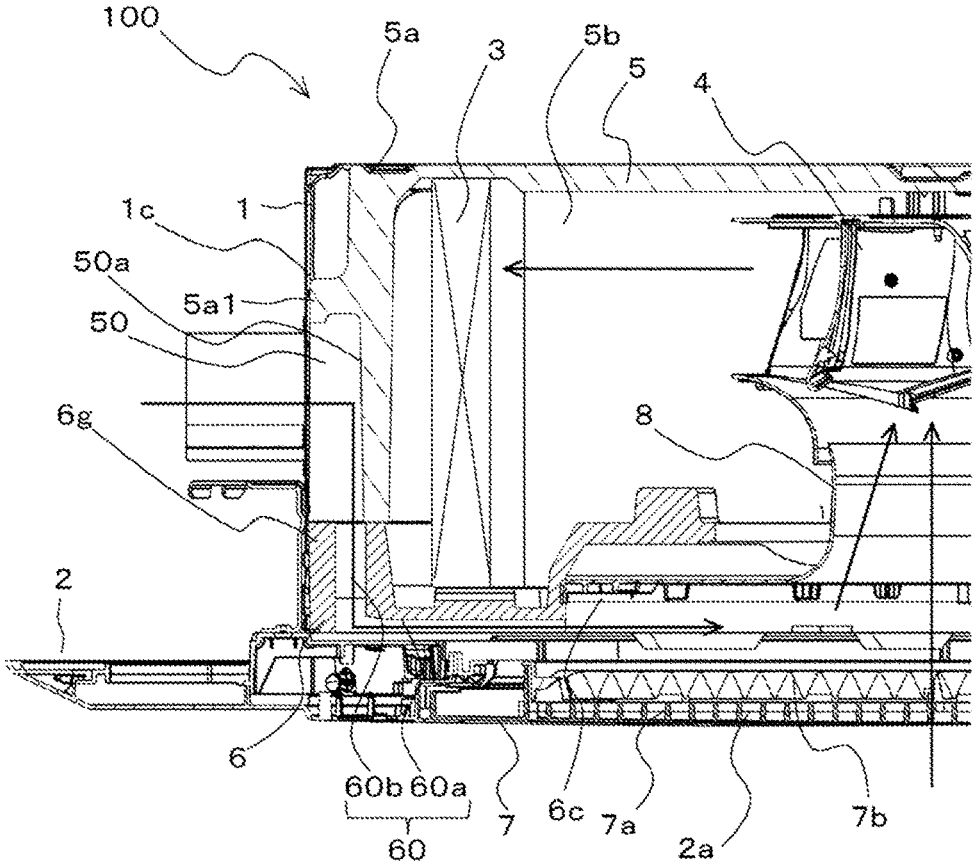
FIG. 24 is a sectional view taken along line F-F in FIG. 23.

FIG. 17 is a schematic enlarged perspective view that illustrates the insulation panel 6 illustrated in FIG. 14 with the air-passage block lid 65 and the knob 68 removed. FIG. 18 is a plan view of a part of the lower surface 6*h* of the insulation panel 6 illustrated in FIG. 17. FIG. 19 is a sectional view taken along line D-D in FIG. 18. FIG. 20 is a sectional view taken along line E-E in FIG. 18. FIG., 21 is a perspective view of a duct flange 10 that illustrates the appearance and structure of the duct flange 10. FIG. 22 is a perspective view of the indoor unit 100 illustrated in FIG. 17 with the duct flange 10 attached. FIG. 23 is a front view that illustrates the duct flange 10 illustrated in FIG. 22 as viewed from where outside air enters. FIG. 24 is a sectional view taken along line F-F in FIG. 23. In FIG. 17, a dashed-line arrow schematically represents a state in which the air-passage block lid 65 and the knob 68 are removed from the insulation panel 6. In FIG. 24, solid-line arrows schematically represent the flow of air during driving of the indoor unit 100.

To introduce outside air into the air-conditioned space, the air-passage block lid 65 and the knob 68 are removed from the insulation panel 6. As described above, an on-site worker removes the air-passage block lid 65 and the knob 68 from the insulation panel 6 with a cutter, such as a knife. Removing the air-passage block lid 65 and the knob 68 from the insulation panel 6 allows the second outside-air introduction passage 60 to communicate between the upper surface 6*b* of the insulation panel 6 and the air inlet passage 6*c* of the insulation panel 6. Therefore, removing the air-passage block lid 65 and the knob 68 from the insulation panel 6 allows the air inlet passage 6*c* of the insulation panel 6 to communicate with the first outside-air introduction passage 50 of the insulation box 5.

To introduce the outside air into the air-conditioned space, the outside-air introduction block panel 1*b*1 is removed from the casing 1. As described above, the on-site worker removes the outside-air introduction block panel 1*b*1 from the casing 1 with a cutter, such as a knife. Removing the outside-air introduction block panel 1*b*1 from the casing 1 allows the first outside-air introduction passage 50 to communicate with the outside of the casing 1.

The duct flange 10 is attached to a portion, from which the outside-air introduction block panel 1*b*1 is removed, of the casing 1. The duct flange 10 serves as a joint that connects the casing 1 to a duct (not illustrated) to take the outside air into the air-conditioned space. The duct flange 10 attached to the portion, from which the outside-air introduction block panel 1*b*1 is removed, of the casing 1 defines an air passage to introduce the outside air into the casing 1. The duct may be a duct newly installed in the building having the air-conditioned space or an existing duct in the building.

The duct flange 10 includes a flat annular ring 10*a* to be secured to the casing 1 with screws or other fasteners, and a hollow cylindrical joint 10*b* joined to an inner edge of the ring 10*a* and connectable to a duct. The joint 10*b* has a fastener hole 10*b*1 to receive a fastener, such as a screw, for fastening a duct. The shape of the ring 10*a* is not limited to a flat annular shape. For example, the ring 10*a* may be a part that has a rectangular outline shape and a circular hole. The shape of the joint 10*b* is not limited to a hollow cylindrical shape. The joint 10*b* may have any other shape that conforms to the shape of the duct. For the duct having a rectangular shape, the joint 10*b* may have a rectangular tubular shape.

In the example described below, the indoor unit 100 with the outside-air introduction block panel 1*b*1 and the air-passage block lid 65 removed is driven.

In response to driving the indoor unit 100, the fan 4 is rotated and thus causes the aft in the air-conditioned space to be drawn into the air inlet passage 6*c* of the insulation panel 6, and simultaneously causes the outside air to be drawn into the air inlet passage 6*c* of the insulation panel 6. The air in the air-conditioned space is drawn into the air inlet passage 6*c* of the insulation panel 6 through the air inlet 2*a* of the outer panel 2, The outside air is drawn into the air inlet passage 6*c* of the insulation panel 6 via the duct flange 10, the first outside-air introduction passage 50, and the second outside-air introduction passage 60. The outside air and the air from the air-conditioned space having been drawn into the air inlet passage 6*c* join together in the air inlet passage Sc. The air is then sent to the heat exchanger 3 via the flared duct 8 by rotation of the fan 4. In the heat exchanger 3, the air sent by the fan 4 and passing through the heat exchanger 3 exchanges heat with the refrigerant flowing inside the heat exchanger 3. The air subjected to heat exchange in the heat exchanger 3 is sent, by rotation of the fan 4, to the air outlets 2*b* of the outer panel 2 through the air outlet passages 6*d* of the insulation panel 6. The air is blown from the air outlets 2*b* of the outer panel 2 into the air-conditioned space.

After removal of the outside-air introduction block panel 1*b*1 and the air-passage block lid 65, the outside air is drawn to the air inlet passage 6*c* of the insulation panel 6 via the duct flange 10, the first outside-air introduction passage 50, and the second outside-air introduction passage 60 without being blown into the air-conditioned space. During driving of the indoor unit 100 with the outside-air introduction block panel 1*b*1 and the air-passage block lid 65 removed, the outside air and the air from the air-conditioned space join together in the air inlet passage 6*c*. The air is then subjected to heat exchange in the heat exchanger 3. Therefore, the second outside-air introduction passage 60 communicable with the air inlet passage 6*c* in the insulation panel 6 reduces or eliminates an increase or decrease in temperature of the air-conditioned space caused by introduction of outside air.

REFERENCE SIGNS LIST

1: casing,
1*a*: corner portion,
1*b*: closing panel,
1*b*1: outside-air introduction block panel,
1*c*: inner wall surface,
2: outer panel,
2*a*: air inlet,
2*b*: air outlet,
2*c*: vane,
3: heat exchanger,
4: fan,
4*a*: suction side,
4*b*: rotary shaft,
4*c*: blade,
5: insulation box,
5*a*: outer wall surface,
5*a*1: corner surface,
5*b*: space,
5*c*: partition,
5*d*: end,
6: insulation panel,
6*a*: side face,
6*b*: upper surface,
6*c*: air inlet passage,
6*d*: air outlet passage,
6*d*1: distribution passage,
6*d*2: distribution passage,
6*d*3: distribution passage,
6*d*4: distribution passage,
6*d*5: distribution passage,
6*d*6: distribution passage,
6*d*7: distribution passage,
6*d*8: distribution passage,
6*e*: water receiving groove,
6*e*1: rib,
6*f*: air passage wall,
6*g*: corner portion,
6*h*: lower surface,
7: guard panel,
7*a*: grille,
7*b*: filter,
8: flared duct,
10: duct flange,
10*a*: ring,
10*b*: joint,
10*b*1: fastener hole,
50: first outside-air introduction passage,
50*a*: outside-air inlet groove,
60: second outside-air introduction passage,
60*a*: outside-air outlet groove,
60*b*: communication path,
65: air-passage block lid,
65*a*: outer edge,
65*a*1: cut groove,
68: knob,
100: indoor unit,
200: outdoor unit,
210: compressor,
220: four-way valve,
230: heat source side heat exchanger,
240: expansion valve,
300: first extension pipe,
400: second extension pipe,
500: air-conditioning apparatus

The invention claimed is:

1. An indoor unit for an air-conditioning apparatus, the indoor unit comprising:

an outer panel disposed on a ceiling of an air-conditioned space, the outer panel having an air inlet and an air outlet;

a fan configured to send air from the air inlet to the air outlet;

a heat exchanger configured to subject air sent from the air inlet to heat exchange;

an insulation box that has a space that receives the heat exchanger and the fan;

an insulation panel disposed between the outer panel and the insulation box, the insulation panel having an air inlet passage and an air outlet passage, the air inlet passage communicating between the air inlet and the space to guide air taken in through the air inlet to the heat exchanger, the air outlet passage communicating between the air outlet and the space to guide air that leaves the heat exchanger to the air outlet; and a casing to which the outer panel is attached, the casing containing the insulation box and the insulation panel, the insulation box having a first outside-air introduction passage that is located apart from the space and that is communicable with an outside of the casing, the insulation panel having a second outside-air introduction passage that is located apart from the air outlet passage and that includes an outside-air outlet groove located in a surface of the insulation panel that faces the outer panel, the outside-air outlet groove communicating with the air inlet passage, the second outside-air introduction passage further including a communication path communicable between the outside-air outlet groove and the first outside-air introduction passage, the insulation panel further having an air-passage block lid that is located in the communication path to block communication between the air inlet passage and the first outside-air introduction passage, the air-passage block lid being removable in its entirety from the insulation panel and from the indoor unit.

2. The indoor unit for an air-conditioning apparatus of claim 1, wherein the air outlet passage includes a plurality of distribution passages separate from each other, and wherein the second outside-air introduction passage and the plurality of distribution passages are spaced apart from each other around the air inlet passage.

3. The indoor unit for an air-conditioning apparatus of claim 1, wherein the outer panel is sealingly secured to the surface of the insulation panel having the outside-air outlet groove.

4. The indoor unit for an air-conditioning apparatus of claim 1, wherein the communication path is a hole communicable between the outside-air outlet groove and the first outside-air introduction passage.

5. The indoor unit for an air-conditioning apparatus of claim 1, wherein the air-passage block lid is integral with the insulation panel.

6. The indoor unit for an air-conditioning apparatus of claim 1, wherein the insulation panel includes a knob on a surface of the air-passage block lid that is adjacent to the outside-air outlet groove, and the knob is integral with the air-passage block lid.

7. The indoor unit for an air-conditioning apparatus of claim 1, wherein the insulation panel has a marker that designates an outer edge of the air-passage block lid that is adjacent to the outside-air outlet groove.

8. The indoor unit for an air-conditioning apparatus of claim 7, wherein the marker is a cut groove being a groove that defines the outer edge around the air-passage block lid, the cut groove being configured and adapted to receive an edge of a cutter.

9. The indoor unit for an air-conditioning apparatus of claim 1, wherein the first outside-air introduction passage includes an outside-air inlet groove located in an outer wall surface of the insulation box, and wherein the outer wall surface of the insulation box having the outside-air inlet groove is tightly secured to the casing.

10. The indoor unit for an air-conditioning apparatus of claim 1, wherein the casing includes an outside-air introduction block panel that blocks communication between the outside of the casing and the first outside-air introduction passage, and the outside-air introduction block panel is removable from the casing.

11. The indoor unit for an air-conditioning apparatus of claim 10, wherein the outside-air introduction block panel is integral with the casing.

12. The indoor unit for an air-conditioning apparatus of claim 10, wherein the outside-air introduction block panel is configured as integrally formed with the casing in a same sheet.

13. An air-conditioning apparatus comprising the indoor unit of claim 1.

14. The indoor unit for an air-conditioning apparatus of claim 1, wherein the air-passage block lid is configured as integrally molded with the insulation panel.

15. The indoor unit for an air-conditioning apparatus of claim 1, wherein the insulation panel includes a knob on a surface of the air-passage block lid that is adjacent to the outside-air outlet groove, and the knob is configured as integrally molded with the air-passage block lid and with the insulation panel.

* * * * *